US010760832B2

(12) United States Patent
Hatomura et al.

(10) Patent No.: US 10,760,832 B2
(45) Date of Patent: Sep. 1, 2020

(54) AIR-CONDITIONING APPARATUS

(71) Applicant: Mitsubishi Electric Corporation, Tokyo (JP)

(72) Inventors: Takeshi Hatomura, Tokyo (JP); Keisuke Hokazono, Tokyo (JP); Yutaka Aoyama, Tokyo (JP); Shuhei Mizutani, Tokyo (JP); Takuya Matsuda, Tokyo (JP); Ryota Akaiwa, Tokyo (JP); Yoji Onaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 2 days.

(21) Appl. No.: 16/313,301

(22) PCT Filed: May 24, 2017

(86) PCT No.: PCT/JP2017/019337
§ 371 (c)(1),
(2) Date: Dec. 26, 2018

(87) PCT Pub. No.: WO2018/047416
PCT Pub. Date: Mar. 15, 2018

(65) Prior Publication Data

US 2019/0162454 A1 May 30, 2019

(30) Foreign Application Priority Data

Sep. 12, 2016 (WO) ..... PCT/JP2016/076784

(51) Int. Cl.
*F25B 39/02* (2006.01)
*F25B 41/04* (2006.01)
(Continued)

(52) U.S. Cl.
CPC ..... *F25B 39/02* (2013.01); *F24F 11/43* (2018.01); *F25B 5/02* (2013.01); *F25B 6/04* (2013.01);
(Continued)

(58) Field of Classification Search
CPC ..... F24F 11/43; F25B 41/046; F25B 39/02; F25B 47/02; F25B 6/04; F25B 13/00;
(Continued)

(56) References Cited

U.S. PATENT DOCUMENTS 5,094,293 A 3/1992 Shinmura
6,273,184 B1 8/2001 Nishishita
(Continued)

FOREIGN PATENT DOCUMENTS

CN 102706046 A 10/2012
JP H02-219966 A 9/1990
(Continued)

OTHER PUBLICATIONS

Office Action dated Dec. 3, 2019 issued in corresponding JP patent application No. 2018-538022 (and English translation).
(Continued)

*Primary Examiner* — Cassey D Bauer
*Assistant Examiner* — Martha Tadesse
(74) *Attorney, Agent, or Firm* — Posz Law Group, PLC

(57) ABSTRACT

An air-conditioning apparatus includes a main circuit in which a compressor, a refrigerant flow switching device, a load side heat exchanger, a load side expansion device, and a plurality of heat source side heat exchangers are sequentially connected. When the plurality of heat source side heat exchangers are used as condensers, the first heat source side heat exchanger and the second heat source side heat exchanger are connected in series. When the plurality of heat source side heat exchangers are used as evaporators, the first
(Continued)

heat source side heat exchanger and the second heat source side heat exchanger are connected in parallel. A distribution adjustment header on an inlet side of at least either the first heat source side heat exchanger or the second heat source side heat exchanger when the plurality of heat source side heat exchangers are used as evaporators.

18 Claims, 5 Drawing Sheets

(51) Int. Cl.

| | |
|---|---|
| ***F25B 5/02*** | (2006.01) |
| ***F25B 6/04*** | (2006.01) |
| ***F25B 47/02*** | (2006.01) |
| ***F24F 11/43*** | (2018.01) |
| ***F25B 13/00*** | (2006.01) |

(52) U.S. Cl.
CPC ..... *F25B 13/00* (2013.01); *F25B 41/046* (2013.01); *F25B 47/02* (2013.01); *F25B 2313/02533* (2013.01); *F25B 2313/02541* (2013.01); *F25B 2313/02542* (2013.01); *F25B 2313/0314* (2013.01); *F25B 2500/01* (2013.01); *F25B 2600/2519* (2013.01); *F25B 2700/1931* (2013.01); *F25B 2700/1933* (2013.01)

(58) Field of Classification Search
CPC ..... F25B 5/02; F25B 2313/02541; F25B 2313/02542; F25B 2700/1933; F25B 2313/0314; F25B 2600/2519; F25B 2313/02533; F25B 2700/1931; F25B 41/003
See application file for complete search history.

(56) References Cited

U.S. PATENT DOCUMENTS

| | | | | |
|---|---|---|---|---|
| 9,140,474 | B2 | 9/2015 | Jang et al. | |
| 9,791,189 | B2 * | 10/2017 | Matsui | F25B 13/00 |
| 2012/0118533 | A1 | 5/2012 | Jang et al. | |
| 2014/0245766 | A1 | 9/2014 | Wakamoto et al. | |
| 2014/0311172 | A1 * | 10/2014 | Iwasaki | F24F 1/06 62/151 |
| 2015/0101363 | A1 * | 4/2015 | Matsuda | F28F 9/0209 62/525 |
| 2015/0276280 | A1 | 10/2015 | Furui et al. | |
| 2015/0362222 | A1 * | 12/2015 | Matsuda | F28D 1/0476 62/324.1 |
| 2016/0047581 | A1 * | 2/2016 | Cho | F25B 41/003 62/529 |
| 2016/0123645 | A1 * | 5/2016 | Kim | F25B 49/02 62/115 |
| 2017/0205128 | A1 * | 7/2017 | Onaka | F25B 40/00 |
| 2017/0370627 | A1 | 12/2017 | Takenaka et al. | |
| 2018/0156498 | A1 * | 6/2018 | Matsumoto | F25B 41/046 |
| 2018/0292096 | A1 * | 10/2018 | Onaka | F24F 1/50 |
| 2019/0137148 | A1 * | 5/2019 | Matsuda | F25B 41/062 |
| 2019/0145669 | A1 * | 5/2019 | Tanaka | F25B 39/028 62/115 |
| 2019/0234626 | A1 * | 8/2019 | Onaka | F25B 39/02 |
| 2019/0383532 | A1 * | 12/2019 | Mizutani | F24F 5/00 |
| 2020/0041178 | A1 * | 2/2020 | Onaka | F28F 9/0204 |

FOREIGN PATENT DOCUMENTS

| | | | | |
|---|---|---|---|---|
| JP | H03-055490 | A | | 3/1991 |
| JP | H03-112671 | U | | 11/1991 |
| JP | 04340063 | A | * | 11/1992 |
| JP | H04-340063 | A | | 11/1992 |
| JP | 05223490 | A | * | 8/1993 |
| JP | H05-223490 | A | | 8/1993 |
| JP | H05-264126 | A | | 10/1993 |
| JP | H11-264675 | A | | 9/1999 |
| JP | H11-294984 | A | | 10/1999 |
| JP | 2003-121019 | A | | 4/2003 |
| JP | 2010-139097 | A | | 6/2010 |
| JP | 2010139097 | A | * | 6/2010 |
| JP | 2012-107857 | A | | 6/2012 |
| JP | 2012-163310 | A | | 8/2013 |
| JP | 2015-017738 | A | | 1/2015 |
| JP | 2015-102311 | A | | 6/2015 |
| JP | 2015-117936 | A | | 6/2015 |
| JP | 2015102311 | A | * | 6/2015 |
| WO | 2013/038615 | A1 | | 3/2013 |
| WO | 2013/111177 | A1 | | 8/2013 |
| WO | 2016/017430 | A1 | | 2/2016 |
| WO | 2016/113851 | A1 | | 7/2016 |

OTHER PUBLICATIONS

International Search Report of the International Searching Authority dated Aug. 29, 2017 for the corresponding international application No. PCT/JP2017/019337 (and English translation).

* cited by examiner

AIR-CONDITIONING APPARATUS

CROSS REFERENCE TO RELATED APPLICATION

This application is a U.S. national stage application of PCT/JP2017/019337 filed on May 24, 2017, which claims priority to the International Application No. PCT/JP2016/076784 filed on Sep. 12, 2016, the contents of which are incorporated herein by reference.

TECHNICAL FIELD

The present invention relates to an air-conditioning apparatus in which when a plurality of heat source side heat exchangers are used as condensers, at least two heat source side heat exchangers are connected to each other in series through which refrigerant flows, and when a plurality of heat source side heat exchangers are used as evaporators, at least two heat source side heat exchangers are connected to each other in parallel through which refrigerant flows.

BACKGROUND ART

A conventionally known air-conditioning apparatus, such as a multi-air-conditioning apparatus for a building, includes a refrigerant circuit that connects an outdoor unit, which is a heat source unit arranged outside the building, and an indoor unit arranged inside the building to each other by a pipe. In the refrigerant circuit, refrigerant circulates, and the refrigerant transfers or removes heat to heat or cool indoor air, thereby performing heating or cooling of an air-conditioned space.

When a plurality of heat exchangers connected to each other in parallel are used as evaporators like outdoor heat exchangers during a heating operation, the plurality of heat exchangers are connected to each other in parallel through which refrigerant flows. This can reduce pressure loss in the evaporators, improves the performance of the evaporators, and improves the heating performance.

When the plurality of heat exchangers are used as condensers during a cooling operation, however, the plurality of heat exchangers are connected to each other in parallel through which refrigerant flows, resulting in a reduction in the flow speed of the refrigerant flowing through the condensers. This reduces an intra-pipe heat transfer coefficient, reduces the performance of the condensers, and reduces the cooling performance.

To address the above issue, there is a technique for switching flow paths by using a plurality of flow switching valves to improve the performance of both the condensers and the evaporators. In this technique, when a plurality of heat exchangers are used as condensers, flow paths are switched to connect the plurality of heat exchangers to each other in series through which refrigerant flows. This increases the flow speed of the refrigerant, thereby improving the performance of the condensers. When the plurality of heat exchangers are used as evaporators, the flow paths are switched to connect the plurality of heat exchangers to each other in parallel through which refrigerant flows. This reduces pressure loss, improving the performance of the evaporators. Such a technique for improving performance during the cooling operation and the heating operation has been proposed (see, for example, Patent Literatures 1 and 2).

CITATION LIST

Patent Literature

Patent Literature 1: Japanese Unexamined Patent Application Publication No. 2003-121019

Patent Literature 2: Japanese Unexamined Patent Application Publication No. 2015-117936

SUMMARY OF INVENTION

Technical Problem

In an air-conditioning apparatus described in Patent Literature 1, switching of a plurality of refrigerant flow switching valves allows a plurality of heat exchangers to be connected to each other in series, through which refrigerant flows, when an outdoor heat exchanger unit is used as a condenser during a cooling operation. This increases the flow speed of the refrigerant, improving the performance of the condenser.

On the other hand, switching of the plurality of refrigerant flow switching valves allows a plurality of heat exchangers forming the outdoor heat exchanger unit to be connected to each other in parallel, through which refrigerant flows, when the outdoor heat exchanger unit is used as an evaporator during a heating operation. This reduces pressure loss in the evaporator, thereby improving the performance of the evaporator.

However, when the outdoor heat exchanger unit is used as an evaporator during the heating operation, it is not possible to uniformly distribute required refrigerant in accordance with the heat transfer area of each of the plurality of heat exchangers and the air velocity distribution in the stage direction of the heat exchanger. This prevents sufficient improvement in the performance of the evaporator. In addition, a flow of refrigerant more than the processing capabilities of the evaporator causes frost formation.

That is, the reduction in refrigeration cycle efficiency impairs power-saving performance. In addition, the frost formation impairs indoor environmental comfort.

In an air-conditioning apparatus described in Patent Literature 2, distributors are used to uniformly distribute required refrigerant, when an outdoor heat exchanger unit is used as an evaporator during a heating operation, in accordance with the heat transfer area of each of a plurality of heat exchangers and the air velocity distribution in the stage direction of the heat exchanger. This sufficiently improves the performance of the evaporator.

However, due to the connection of narrow and long capillary tubes to the distributors, when the outdoor heat exchanger is used as a condenser during the cooling operation, pressure loss occurs in the capillary tubes. The pressure loss leads to a reduction in the performance of the condenser and prevents sufficient improvement in the performance of the condenser.

That is, the reduction in refrigeration cycle efficiency impairs power-saving performance.

The present invention is aimed at solving the problems described above, and an object thereof is to provide an air-conditioning apparatus whose power-saving performance is improved by preventing a reduction in refrigeration cycle efficiency.

Solution to Problem

An air-conditioning apparatus according to an embodiment of the present invention includes a main circuit in which a compressor, a refrigerant flow switching device, a load side heat exchanger, a load side expansion device, and a plurality of heat source side heat exchangers are sequentially connected by a pipe and in which refrigerant circulates, wherein the plurality of heat source side heat exchangers include a first heat source side heat exchanger and a second heat source side heat exchanger, when the plurality of heat source side heat exchangers are used as condensers, the first heat source side heat exchanger and the second heat source side heat exchanger are connected to each other in series by a series refrigerant flow path, when the plurality of heat source side heat exchangers are used as evaporators, the first heat source side heat exchanger and the second heat source side heat exchanger are connected to each other in parallel by a parallel refrigerant flow path, and a distribution adjustment header that adjusts distribution of the refrigerant is disposed at a position in a refrigerant flow path on an inlet side of at least either the first heat source side heat exchanger or the second heat source side heat exchanger when the plurality of heat source side heat exchangers are used as evaporators.

Advantageous Effects of Invention

In an air-conditioning apparatus according to an embodiment of the present invention, a distribution adjustment header that adjusts distribution of refrigerant is disposed at a position in the refrigerant flow path on the inlet side of at least either a first heat source side heat exchanger or a second heat source side heat exchanger when a plurality of heat source side heat exchangers are used as evaporators. Thus, a distribution adjustment header, instead of a narrow and long capillary tube as an existing distributor, is provided at a position in the refrigerant flow path on the outlet side of at least either the first heat source side heat exchanger or the second heat source side heat exchanger when the plurality of heat source side heat exchangers are used as condensers. This can reduce pressure loss, resulting in an improvement in the performance of the condensers. In addition, a distribution adjustment header is provided at a position in the refrigerant flow path on the inlet side of at least either the first heat source side heat exchanger or the second heat source side heat exchanger when the plurality of heat source side heat exchangers are used as evaporators. This allows required refrigerant to be uniformly distributed from the distribution adjustment header in accordance with the heat transfer area of the heat source side heat exchanger including the distribution adjustment header and in accordance with the air velocity distribution in the stage direction of the heat exchanger. Thus, the performance of the evaporators can be improved.

Additionally, no flowing of refrigerant more than the processing capabilities of the evaporators can prevent frost formation. Accordingly, a reduction in refrigeration cycle efficiency is prevented, thereby improving power-saving performance. In addition, the prevention of frost formation can ensure indoor environmental comfort.

DESCRIPTION OF EMBODIMENTS

Figure 1:
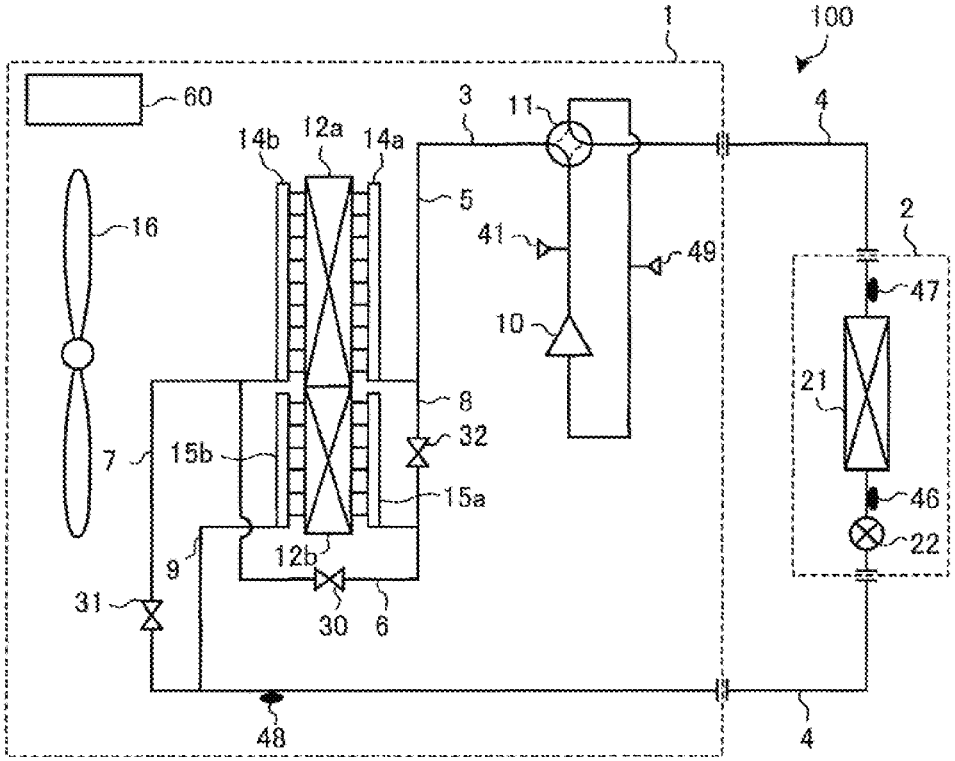
FIG. 1 is a schematic circuit configuration diagram illustrating an example circuit configuration of an air-conditioning apparatus according to Embodiment 1 of the present invention.

The following describes embodiments of the present invention with reference to the drawings.

In the drawings, the same numerals are used to designate the same or corresponding portions. This applies throughout the description.

Further, throughout the description, constituent elements are described for illustrative purposes only, and the constituent elements are not limited thereto.

Embodiment 1

FIG. 1 is a schematic circuit configuration diagram illustrating an example circuit configuration of an air-conditioning apparatus according to Embodiment 1 of the present invention.

An air-conditioning apparatus 100 illustrated in FIG. 1 has a configuration in which an outdoor unit 1 and an indoor unit 2 are connected to each other by a main pipe 4.

In FIG. 1, a single indoor unit 2 is connected to the outdoor unit 1 by the main pipe 4, by way of example. However, the number of indoor units 2 connected to the outdoor unit 1 is not limited to one, and a plurality of indoor units 2 may be connected to the outdoor unit 1.

[Outdoor Unit 1]

The outdoor unit 1 includes, as elements constituting the main circuit, a compressor 10, a refrigerant flow switching device 11, a first heat source side heat exchanger 12*a*, and a second heat source side heat exchanger 12*b*.

In a main circuit, the compressor 10, the refrigerant flow switching device 11, a load side heat exchanger 21, a load side expansion device 22, the first heat source side heat exchanger 12*a*, and the second heat source side heat exchanger 12*b* are sequentially connected by a refrigerant pipe 3, and refrigerant circulates.

The refrigerant pipe 3 is a term used to collectively describe pipes that allows refrigerant used in the air-conditioning apparatus 100 to pass therethrough. The refrigerant pipe 3 includes, for example, the main pipe 4, a primary pipe 5, a series pipe 6, a first parallel pipe 7, a second parallel pipe 8, a third parallel pipe 9, a first header 14*a*, a second header 14*b*, a third header 15*a*, a fourth header 15*b*, and so forth.

The main pipe 4 couples the outdoor unit 1 and the indoor unit 2 together. The primary pipe 5 couples the refrigerant flow switching device 11 and the first header 14*a* together. The series pipe 6 couples the first heat source side heat exchanger 12*a* and the second heat source side heat exchanger 12*b* together in series via the second header 14*b* and the third header 15*a*, respectively. That is, the series pipe 6 couples the second header 14*b* and the third header 15*a* together. The first parallel pipe 7 couples the first heat source side heat exchanger 12*a* and the load side expansion device 22 together via the second header 14*b* and the main pipe 4, respectively. That is, the first parallel pipe 7 couples the second header 14*b* and the main pipe 4 together. The second parallel pipe 8 couples the refrigerant flow switching device 11 and the second heat source side heat exchanger 12*b* together via the primary pipe 5 and the third header 15*a*. That is, the second parallel pipe 8 couples the primary pipe 5 and the third header 15*a* together. The third parallel pipe 9 couples the second heat source side heat exchanger 12*b* and the load side expansion device 22 together via the fourth header 15*b* and the main pipe 4, respectively. That is, the third parallel pipe 9 couples the fourth header 15*b* and the main pipe 4 together.

In Embodiment 1, the outdoor unit 1 includes the first heat source side heat exchanger 12*a* and the second heat source side heat exchanger 12*b*. However, the outdoor unit 1 may also include any other heat source side heat exchanger.

The outdoor unit 1 includes, as a heat exchanger flow switching device, a first opening and closing device 30, a second opening and closing device 31, and a third opening and closing device 32.

The outdoor unit 1 is further provided with a fan 16, which is an air-sending device. Examples of the fan 16 include a top-flow fan that is positioned above the first heat source side heat exchanger 12*a* and the second heat source side heat exchanger 12*b*.

The compressor 10 sucks refrigerant and compresses the refrigerant into a high-temperature, high-pressure state. The compressor 10 is formed of, for example, a capacity-controllable inverter compressor or the like. The compressor 10 is formed of, for example, a compressor having a low-pressure shell structure including a compression chamber defined inside a hermetic container which is placed under a low refrigerant pressure atmosphere to suck and compress the low-pressure refrigerant in the sealed container.

The refrigerant flow switching device 11 is formed of, for example, a four-way valve or the like. The refrigerant flow switching device 11 switches a refrigerant flow path in a cooling operation mode, a refrigerant flow path in a heating operation mode, and a refrigerant flow path in a defrosting operation mode.

The cooling operation mode and the defrosting operation mode are modes in which the first heat source side heat exchanger 12*a* and the second heat source side heat exchanger 12*b* are used as condensers or gas coolers. The heating operation mode is a mode in which the first heat source side heat exchanger 12*a* and the second heat source side heat exchanger 12*b* are used as evaporators.

Each of the first heat source side heat exchanger 12*a* and the second heat source side heat exchanger 12*b* includes a plurality of heat transfer pipes, which are elements constituting the heat exchanger, and a plurality of fins, which are elements constituting the heat exchanger.

The plurality of heat transfer pipes are flat pipes. The plurality of heat transfer pipes extend in the horizontal direction. The plurality of heat transfer pipes form a plurality of refrigerant flow paths in each of the first heat source side heat exchanger 12*a* and the second heat source side heat exchanger 12*b*.

The plurality of fins, each of which is a plate-shaped fin, are stacked together with a predetermined space being present therebetween. The plurality of fins extend in the vertical direction, which is a direction perpendicular to the direction in which the heat transfer pipes extend, and the plurality of heat transfer pipes are inserted through the plurality of fins.

The first heat source side heat exchanger 12*a* is arranged above the second heat source side heat exchanger 12*b* along a line vertical to the second heat source side heat exchanger 12*b*. A portion of the first heat source side heat exchanger 12*a* and the second heat source side heat exchanger 12*b* are integrally formed in such a manner as to share a fin, which is an element constituting the heat exchanger. That is, a portion of the first heat source side heat exchanger 12*a* and a portion of the second heat source side heat exchanger 12*b* are formed such that their heat transfer pipes are inserted through the same fin.

The remaining portion other than the portion of the first heat source side heat exchanger 12*a* is formed to be separated from the second heat source side heat exchanger 12*b*. That is, the rest other than the portion of the first heat source side heat exchanger 12*a* and the rest other than the portion of the second heat source side heat exchanger 12*b* are formed such that the heat transfer pipes are inserted through different fins.

The first heat source side heat exchanger 12*a* and the second heat source side heat exchanger 12*b* function as condensers in the cooling operation mode and the defrosting operation mode, and function as evaporators in the heating operation mode. The first heat source side heat exchanger 12*a* and the second heat source side heat exchanger 12*b* exchange heat between the air supplied from the fan 16 and the refrigerant passing through the plurality of heat transfer pipes.

The first heat source side heat exchanger 12*a* is formed to have a larger heat transfer area than the heat transfer area of the second heat source side heat exchanger 12*b*. Thus, the number of heat transfer pipes in the first heat source side heat exchanger 12*a* is larger than the number of heat transfer pipes in the second heat source side heat exchanger 12*b*.

The first header 14*a* is disposed at a position in the refrigerant flow path on the inlet side of the first heat source side heat exchanger 12*a* when the first heat source side heat exchanger 12*a* is used as a condenser.

The first header 14*a* includes a header main pipe and a plurality of branch pipes.

The header main pipe extends in the vertical direction. The header main pipe is connected to the primary pipe 5, which is coupled to the refrigerant flow switching device 11. A lower portion of the header main pipe is connected to the primary pipe 5.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the first heat source side heat exchanger 12*a*. The plurality of branch pipes are each a pipe narrower than the header main pipe.

The first header 14*a* allows the refrigerant to flow into or out of each of the heat transfer pipes of the first heat source side heat exchanger 12*a* through the branch pipe connected to the heat transfer pipe.

The second header 14*b* is disposed at a position in the refrigerant flow path on the inlet side of the first heat source side heat exchanger 12*a* when the first heat source side heat exchanger 12*a* is used as an evaporator.

The second header 14*b* includes a header main pipe and a plurality of branch pipes.

The header main pipe extends in the vertical direction. The header main pipe is connected to the first parallel pipe 7, which is coupled to the load side expansion device 22 by the main pipe 4. A lower portion of the header main pipe is connected to the first parallel pipe 7.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the first heat source side heat exchanger 12*a*. The plurality of branch pipes are each a pipe narrower than the header main pipe.

The second header 14*b* allows the refrigerant to flow into or out of each of the heat transfer pipes of the first heat source side heat exchanger 12*a* through the branch pipe connected to the heat transfer pipe.

The third header 15*a* is disposed at a position in the refrigerant flow path on the inlet side of the second heat source side heat exchanger 12*b* when the second heat source side heat exchanger 12*b* is used as a condenser.

The third header 15*a* includes a header main pipe and a plurality of branch pipes.

The header main pipe extends in the vertical direction. The header main pipe is connected to the second parallel pipe 8, which is coupled to the refrigerant flow switching device 11 via the primary pipe 5. A lower portion of the header main pipe is connected to the second parallel pipe 8.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the second heat source side heat exchanger 12*b*. The plurality of branch pipes are each a pipe narrower than the header main pipe.

The third header 15*a* allows the refrigerant to flow into or out of each of the heat transfer pipes of the second heat source side heat exchanger 12*b* through the branch pipe connected to the heat transfer pipe.

The fourth header 15*b* is disposed at a position in the refrigerant flow path on the inlet side of the second heat source side heat exchanger 12*b* when the second heat source side heat exchanger 12*b* is used as an evaporator.

The fourth header 15*b* includes a header main pipe and a plurality of branch pipes.

The header main pipe extends in the vertical direction. The header main pipe is connected to the third parallel pipe 9, which is coupled to the load side expansion device 22 via the main pipe 4. A lower portion of the header main pipe is connected to the third parallel pipe 9.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the second heat source side heat exchanger 12*b*. The plurality of branch pipes are each a pipe narrower than the header main pipe.

The fourth header 15*b* allows the refrigerant to flow into or out of each of the heat transfer pipes of the second heat source side heat exchanger 12*b* through the branch pipe connected to the heat transfer pipe.

In each of the second header 14*b* and the fourth header 15*b*, the branch pipes protrude toward the inside of the corresponding header main pipe. The protrusion of the branch pipes toward the inside of the header main pipe allows a required amount of refrigerant to be supplied to each refrigerant flow path on the inlet side when the first heat source side heat exchanger 12*a* and the second heat source side heat exchanger 12*b* are used as evaporators in accordance with the heat transfer area and the air velocity distribution in the stage direction of the heat exchanger. That is, the second header 14*b* and the fourth header 15*b* are each a distribution adjustment header that distributes and adjusts the amount of refrigerant to be supplied.

The series pipe 6 couples the second header 14*b* and the third header 15*a* together. When the first heat source side heat exchanger 12*a* and the second heat source side heat exchanger 12*b* are used as condensers, the series pipe 6 allows high-pressure refrigerant in a two-phase state or liquid state with low quality, which has flowed out of the second header 14*b*, to flow into the second heat source side heat exchanger 12*b* through the first opening and closing device 30 and the third header 15*a*.

The series pipe 6 is provided with the first opening and closing device 30.

The first parallel pipe 7 couples the second header 14*b* and the main pipe 4 together. When the first heat source side heat exchanger 12*a* and the second heat source side heat exchanger 12*b* are used as evaporators, the first parallel pipe 7 allows low-pressure refrigerant in a two-phase state or liquid state with low quality to flow into the first heat source side heat exchanger 12*a* via the second header 14*b*.

The first parallel pipe 7 is provided with the second opening and closing device 31.

The second parallel pipe 8 couples the primary pipe 5 and the third header 15*a* together. When the first heat source side heat exchanger 12*a* and the second heat source side heat exchanger 12*b* are used as evaporators, the second parallel pipe 8 allows a flow of low-pressure refrigerant in a two-phase state or gas state with high quality out of the third header 15*a* to join with a flow of low-pressure refrigerant in a two-phase state or gas state with high quality out of the first header 14*a* to direct the joined flows of refrigerant to the refrigerant pipe 3 on the suction side of the compressor 10 via the primary pipe 5.

The second parallel pipe 8 is provided with the third opening and closing device 32.

The third parallel pipe 9 couples the fourth header 15*b* and the main pipe 4 together. When the first heat source side heat exchanger 12*a* and the second heat source side heat exchanger 12*b* are used as evaporators, the third parallel pipe 9 allows low-pressure refrigerant in a two-phase state or liquid state with low quality to flow into the second heat source side heat exchanger 12*b* via the fourth header 15*b*.

The first opening and closing device 30 is arranged in the series pipe 6 and is configured to permit or block the passage of the refrigerant through the series pipe 6. That is, when the first heat source side heat exchanger 12*a* and the second heat source side heat exchanger 12*b* are used as condensers, the first opening and closing device 30 is opened to allow the refrigerant, which has flowed out of the first heat source side heat exchanger 12*a*, to flow into the second heat source side heat exchanger 12*b*. When the first heat source side heat exchanger 12*a* and the second heat source side heat exchanger 12*b* are used as evaporators, the first opening and closing device 30 is closed to block the passage of a portion of the refrigerant that is to flow into the first heat source side heat exchanger 12*a* without bypassing the portion of the refrigerant to the suction side of the compressor 10.

The first opening and closing device 30 is an opening and closing valve or a valve of which the opening degree is adjustable and is formed of a device capable of opening or closing a refrigerant flow path, such as a two-way valve, a solenoid valve, or an electronic expansion valve.

The second opening and closing device 31 is arranged in the first parallel pipe 7 and is configured to permit or block the passage of the refrigerant through the first parallel pipe 7. That is, when the first heat source side heat exchanger 12*a* and the second heat source side heat exchanger 12*b* are used as condensers, the second opening and closing device 31 is closed to block the passage of a portion of the refrigerant, which has flowed out of the first heat source side heat exchanger 12*a*, without bypassing the portion of the refrigerant to the indoor unit 2. When the first heat source side heat exchanger 12*a* and the second heat source side heat exchanger 12*b* are used as evaporators, the second opening and closing device 31 is opened to allow the refrigerant, which has flowed out of the indoor unit 2, to flow into the first heat source side heat exchanger 12*a*.

The second opening and closing device 31 is an opening and closing valve or a valve of which the opening degree is adjustable and is formed of a device capable of opening or closing a refrigerant flow path, such as a two-way valve, a solenoid valve, or an electronic expansion valve.

The third opening and closing device 32 is arranged in the second parallel pipe 8 and is configured to permit or block the passage of the refrigerant through the second parallel pipe 8. That is, when the first heat source side heat exchanger 12*a* and the second heat source side heat exchanger 12*b* are used as condensers, the third opening and closing device 32 is closed to block the passage of a portion of the refrigerant, which has flowed out the refrigerant flow path on the discharge side of the compressor 10, without bypassing the portion of the refrigerant to the second heat source side heat exchanger 12*b*. When the first heat source side heat exchanger 12*a* and the second heat source side heat exchanger 12*b* are used as evaporators, the third opening and closing device 32 is opened to direct the refrigerant, which flows out of the second heat source side heat exchanger 12*b*, to the refrigerant pipe 3 on the suction side of the compressor 10.

The third opening and closing device 32 is an opening and closing valve or a valve of which the opening degree is adjustable and is formed of a device capable of opening or closing a refrigerant flow path, such as a two-way valve, a solenoid valve, or an electronic expansion valve. Alternatively, the third opening and closing device 32 is formed of a check valve or the like, which is a backflow prevention device capable of permitting the passage of the refrigerant from the second heat source side heat exchanger 12*b* and capable of blocking the passage of the refrigerant, which is to flow into the second heat source side heat exchanger 12*b* from the refrigerant pipe 3 on the discharge side of the compressor 10.

The outdoor unit 1 is further provided with a pressure sensor 41 that detects the pressure of high-temperature, high-pressure refrigerant discharged from the compressor 10, and a low-pressure sensor 49 that detects the pressure of low-temperature, low-pressure refrigerant to be sucked into the compressor 10.

Further, a third temperature sensor 48, which is formed of a thermistor or the like, is disposed in the refrigerant pipe 3 between the load side expansion device 22 and a branch portion from the load side expansion device 22 to the first heat source side heat exchanger 12*a* and to the second heat source side heat exchanger 12*b*.

The third temperature sensor 48 detects the temperatures of refrigerant that flows out of or into the first heat source side heat exchanger 12*a* and the second heat source side heat exchanger 12*b*.

[Indoor Unit 2]

The indoor unit 2 includes the load side heat exchanger 21 and the load side expansion device 22 as elements constituting the main circuit.

The load side heat exchanger 21 is connected to the outdoor unit 1 via the main pipe 4. The load side heat exchanger 21 exchanges heat between the air communicating with an indoor space and the incoming refrigerant passing through the main pipe 4 and generates air for heating or air for cooling to be supplied to the indoor space. The load side heat exchanger 21 is blown with indoor air from an air-sending device such as a fan (not illustrated).

The load side expansion device 22 is formed of a device having an opening degree that is controlled to be variable, such as an electronic expansion valve. The load side expansion device 22 has a function of a pressure reducing valve or an expansion valve to reduce the pressure of the refrigerant or expand the refrigerant.

The load side expansion device 22 is disposed upstream of the load side heat exchanger 21 in the cooling operation mode.

The indoor unit 2 is further provided with a first temperature sensor 46 and a second temperature sensor 47, each of which is formed of a thermistor or the like.

The first temperature sensor 46 is disposed in the refrigerant pipe 3 on the refrigerant inlet side of the load side heat exchanger 21 during a cooling operation and detects the temperature of refrigerant that flows into or out of the load side heat exchanger 21.

The second temperature sensor 47 is disposed in the refrigerant pipe 3 on the refrigerant outlet side of the load side heat exchanger 21 during the cooling operation and detects the temperature of refrigerant that flows out of or into the load side heat exchanger 21.

A controller 60, which is formed of a microcomputer or the like, is disposed in the outdoor unit 1 and controls various devices of the air-conditioning apparatus 100 in accordance with detection information detected with the various sensors described above and in accordance with an instruction from a remote control. Examples of the objects to be controlled by the controller 60 include the driving frequency of the compressor 10, the rotation speed (including ON or OFF) of the fan 16, switching of the refrigerant flow switching device 11, the opening degree or opening and closing of the first opening and closing device 30, the opening degree or opening and closing of the second opening and closing device 31, the opening degree or opening and closing of the third opening and closing device 32, and the opening degree of the load side expansion device 22. The controller 60 controls the various devices in the manner described above to execute each of the operation modes described below.

The controller 60 is disposed in the outdoor unit 1, by way of example. However, the controller 60 may be disposed in each unit or may be disposed in the indoor unit 2.

Next, the operation modes to be executed by the air-conditioning apparatus 100 will be described. The air-conditioning apparatus 100 executes the cooling operation mode or the heating operation mode in accordance with an instruction from the indoor unit 2.

The operation modes to be executed by the air-conditioning apparatus 100 illustrated in FIG. 1 include the cooling operation mode in which the indoor unit 2 in operation executes a cooling operation, and the heating operation mode in which the indoor unit 2 in operation executes a heating operation.

The following describes each of the operation modes along with a flow of refrigerant.

[Cooling Operation Mode]

Figure 2:
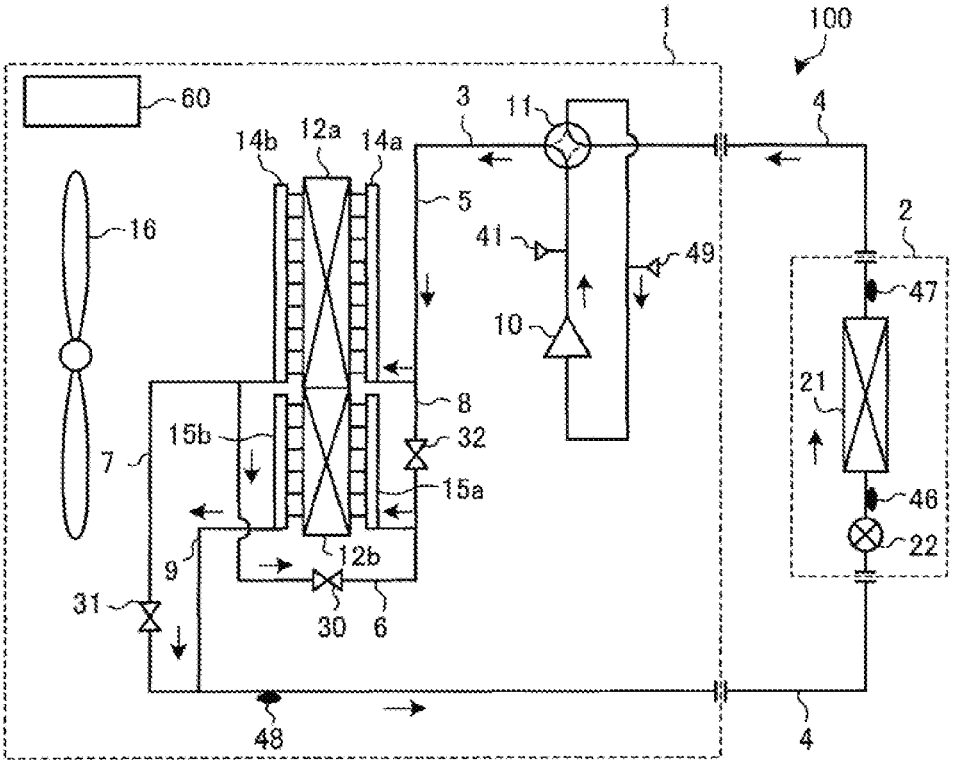
FIG. 2 is a refrigerant circuit diagram illustrating a flow of refrigerant in a cooling operation mode and a defrosting operation mode of the air-conditioning apparatus according to Embodiment 1 of the present invention.

FIG. 2 is a refrigerant circuit diagram illustrating a flow of refrigerant in the cooling operation mode and the defrosting operation mode of the air-conditioning apparatus 100 according to Embodiment 1 of the present invention.

FIG. 2 illustrates a flow of refrigerant in the cooling operation mode when a cooling energy load is generated in the load side heat exchanger 21, by way of example. In FIG. 2, the flow direction of the refrigerant is indicated by a solid line arrow.

As illustrated in FIG. 2, low-temperature, low-pressure refrigerant is compressed by the compressor 10 to be high-temperature, high-pressure gas refrigerant and is discharged. The high-temperature, high-pressure gas refrigerant discharged from the compressor 10 flows into the first heat source side heat exchanger 12*a* via the refrigerant flow switching device 11 and the first header 14*a*. In the first heat source side heat exchanger 12*a*, the flowing gas refrigerant is converted into high-pressure two-phase or liquid refrigerant by transferring heat to the outdoor air to be supplied from the fan 16. The high-pressure refrigerant, which has flowed out of the first heat source side heat exchanger 12*a*, flows into the second heat source side heat exchanger 12*b* via the second header 14*b*, the series pipe 6, the first opening and closing device 30, which is switched to the open state, and the third header 15*a*. In the second heat source side heat exchanger 12*b*, the flowing high-pressure two-phase or liquid refrigerant is converted into high-pressure liquid refrigerant by transferring heat to the outdoor air to be supplied from the fan 16. The high-pressure liquid refrigerant flows out of the outdoor unit 1 via the fourth header 15*b* and the third parallel pipe 9, travels through the main pipe 4, and flows into the indoor unit 2.

The second opening and closing device 31 remains closed, and prevents bypassing of the high-pressure two-phase or liquid refrigerant, which has flowed out of the first heat source side heat exchanger 12*a*, to the indoor unit 2. The third opening and closing device 32 remains closed, and prevents bypassing of the high-temperature, high-pressure gas refrigerant, which has been discharged from the compressor 10, to the second heat source side heat exchanger 12*b*.

That is, in the outdoor unit 1, when the first heat source side heat exchanger 12*a* and the second heat source side heat exchanger 12*b* are used as condensers, the first heat source side heat exchanger 12*a* and the second heat source side heat exchanger 12*b* are connected to each other in series by a series refrigerant flow path.

The series refrigerant flow path is established, when the first heat source side heat exchanger 12*a* and the second heat source side heat exchanger 12*b* are used as condensers, with the first opening and closing device 30 opened, the second opening and closing device 31 closed, and the third opening and closing device 32 closed.

In the indoor unit 2, the high-pressure liquid refrigerant is expanded into low-temperature, low-pressure refrigerant in a two-phase gas-liquid state by the load side expansion device 22. The refrigerant in a two-phase gas-liquid state flows into the load side heat exchanger 21, which is used as an evaporator, and is converted into low-temperature, low-pressure gas refrigerant by removing heat from the indoor air while cooling the indoor air. In this case, the opening degree of the load side expansion device 22 is controlled by the controller 60 so that the superheat (the degree of superheat), which is obtained as the difference between the temperature detected by the first temperature sensor 46 and the temperature detected by the second temperature sensor 47, is kept constant. The gas refrigerant, which has flowed out of the load side heat exchanger 21, travels through the main pipe 4 and flows into the outdoor unit 1 again. The gas refrigerant, which has flowed into the outdoor unit 1, travels through the refrigerant flow switching device 11 and is sucked into the compressor 10 again.

[Advantageous Effects in Cooling Operation Mode]

As described above, in the cooling operation mode, refrigerant flows in the series refrigerant flow path such that the first heat source side heat exchanger 12*a* exchanges heat of the refrigerant and then causes the refrigerant to flow into the second heat source side heat exchanger 12*b* to perform heat exchange. This can reduce the number of refrigerant flow paths compared to a case when the first heat source side heat exchanger 12*a* and the second heat source side heat exchanger 12*b* are connected to each other in parallel through which refrigerant flows. Thus, the flow speed of the refrigerant is increased, and the heat transfer coefficient of the refrigerant is increased. Therefore, the performance of the condensers is improved.

In addition, the first heat source side heat exchanger 12*a* is formed to have a larger heat transfer area than the heat transfer area of the second heat source side heat exchanger 12*b*. Thus, the number of refrigerant flow paths in the first heat source side heat exchanger 12*a* is larger than the number of refrigerant flow paths in the second heat source side heat exchanger 12*b*. Thus, in the first heat source side heat exchanger 12*a*, the high-pressure gas refrigerant transfers heat to the outdoor air and is converted into two-phase refrigerant or saturated liquid refrigerant with low quality, for example, about 0.01 to 0.3, in accordance with the temperature of the outdoor air at that time, which then flows out of the first heat source side heat exchanger 12*a*. Alternatively, in the first heat source side heat exchanger 12*a*, the high-pressure gas refrigerant transfers heat to the outdoor air and is brought into a state in which the subcool (the degree of subcooling), which is the difference between the saturated liquid temperature of the liquid refrigerant and the liquid temperature at the outlet of the first heat source side heat exchanger 12*a*, is low, for example, less than 2 degrees C., which then flows out of the first heat source side heat exchanger 12*a*. Thereafter, the majority of the high-pressure refrigerant, which transfers heat to the outdoor air in the second heat source side heat exchanger 12*b*, is converted into liquid refrigerant having a lower heat transfer coefficient than the two-phase refrigerant. In this case, the number of refrigerant flow paths in the second heat source side heat exchanger 12*b* is smaller than the number of refrigerant flow paths in the first heat source side heat exchanger 12*a*. This can increase the refrigerant flow speed of the liquid refrigerant and increase the heat transfer coefficient of the liquid refrigerant compared to a case when the number of refrigerant flow paths in the second heat source side heat exchanger 12*b* is the same as the number of refrigerant flow paths in the first heat source side heat exchanger 12*a*. Therefore, the performance of the condensers is improved.

The refrigerant, which has flowed out of the first heat source side heat exchanger 12*a*, is supplied to the second heat source side heat exchanger 12*b* via the second header 14*b*, which includes a header main pipe and a plurality of larger and shorter branch pipes than a plurality of narrow and long capillary tubes of a distributor. Thus, in Embodiment 1, pressure loss can be reduced and the difference in temperature between the refrigerant and the air can be kept large, compared to a case when a distributor including a plurality of narrow and long capillary tubes is provided at the position of the second header 14*b*. This prevents a reduction in the capabilities of the condensers. Therefore, the refrigeration cycle efficiency is improved.

[Heating Operation Mode]

Figure 3:
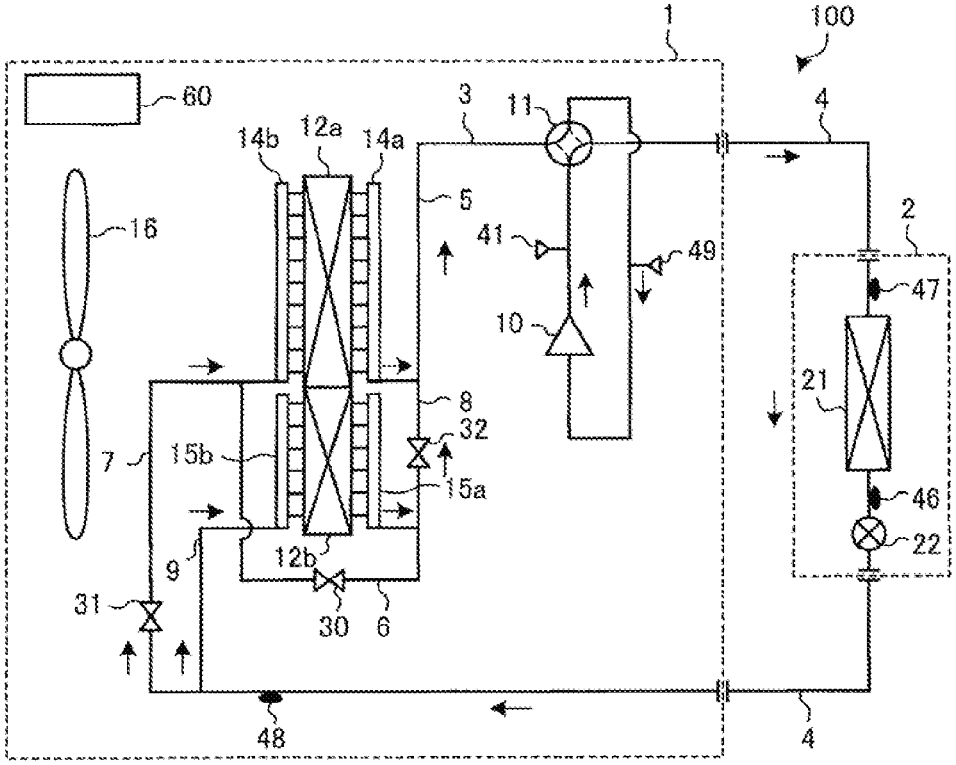
FIG. 3 is a refrigerant circuit diagram illustrating a flow of refrigerant in a heating operation mode of the air-conditioning apparatus according to Embodiment 1 of the present invention.

FIG. 3 is a refrigerant circuit diagram illustrating a flow of refrigerant in the heating operation mode of the air-conditioning apparatus 100 according to Embodiment 1 of the present invention.

FIG. 3 illustrates a flow of refrigerant in the heating operation mode when a heating energy load is generated in the load side heat exchanger 21, by way of example. In FIG. 3, the flow direction of the refrigerant is indicated by a solid line arrow.

As illustrated in FIG. 3, low-temperature, low-pressure refrigerant is compressed by the compressor 10 to high-temperature, high-pressure gas refrigerant which is discharged. The high-temperature, high-pressure gas refrigerant discharged from the compressor 10 travels through the refrigerant flow switching device 11 and flows out of the outdoor unit 1. The high-temperature, high-pressure gas refrigerant, which has flowed out of the outdoor unit 1, travels through the main pipe 4 and is converted into liquid refrigerant by transferring heat to the indoor air in the load side heat exchanger 21 while heating the indoor space. In this case, the opening degree of the load side expansion device 22 is controlled by the controller 60 so that the subcool (the degree of subcooling), which is obtained as the difference between a value obtained by converting the pressure detected by the pressure sensor 41 into a saturation temperature and the temperature detected by the first temperature sensor 46, is kept constant. The liquid refrigerant, which has flowed out of the load side heat exchanger 21, is expanded into medium-temperature, medium-pressure refrigerant in a two-phase gas-liquid state by the load side expansion device 22, which travels through the main pipe 4 and flows into the outdoor unit 1 again.

The medium-temperature, medium-pressure refrigerant in a two-phase gas-liquid state, which has flowed into the outdoor unit 1, branches into flow paths, namely, the first parallel pipe 7 and the third parallel pipe 9.

A portion of the refrigerant that branches and flows into the first parallel pipe 7 flows into the first heat source side heat exchanger 12*a* via the second opening and closing device 31, which is switched to the open state, and the second header 14*b* and is converted into low-temperature, low-pressure gas refrigerant by removing heat from the outdoor air in the first heat source side heat exchanger 12*a*. The gas refrigerant flows out of the first heat source side heat exchanger 12*a* via the first header 14*a*.

The remaining refrigerant, which branches and flows into the third parallel pipe 9, flows into the second heat source side heat exchanger 12*b* via the fourth header 15*b* and is converted into low-temperature, low-pressure gas refrigerant by removing heat from the outdoor air in the second heat source side heat exchanger 12*b*. The gas refrigerant flows out of the second heat source side heat exchanger 12*b* via the third header 15*a*.

The gas refrigerant that flows out of the second heat source side heat exchanger 12*b* joins with the portion of the gas refrigerant, which flows out of the first header 14*a*, in the primary pipe 5 via the second parallel pipe 8 and the third opening and closing device 32, which is switched to the open state. The joined flows of the gas refrigerant are sucked into the compressor 10 again via the refrigerant flow switching device 11.

The first opening and closing device 30 remains closed, and prevents bypassing of the refrigerant, which is to flow into the first heat source side heat exchanger 12*a*, to the compressor 10.

That is, in the outdoor unit 1, when the first heat source side heat exchanger 12*a* and the second heat source side heat exchanger 12*b* are used as evaporators, the first heat source side heat exchanger 12*a* and the second heat source side heat exchanger 12*b* are connected to each other in parallel by a parallel refrigerant flow path.

The parallel refrigerant flow path is established, when the first heat source side heat exchanger 12*a* and the second heat source side heat exchanger 12*b* are used as evaporators, with the first opening and closing device 30 closed, the second opening and closing device 31 opened, and the third opening and closing device 32 opened.

[Advantageous Effects in Heating Operation Mode]

As described above, in the heating operation mode, the first heat source side heat exchanger 12*a* and the second heat source side heat exchanger 12*b* are connected to each other in parallel through which refrigerant flows. This can increase the number of refrigerant flow paths compared to a case when the first heat source side heat exchanger 12*a* and the second heat source side heat exchanger 12*b* are connected to each other in series through which refrigerant flows. Thus, the flow speed of the refrigerant flowing in the first heat source side heat exchanger 12*a* and the second heat source side heat exchanger 12*b*, which are evaporators, is reduced and pressure loss is reduced. Accordingly, the refrigerant pressure on the suction side of the compressor 10 is increased, and the refrigeration cycle efficiency is improved.

Further, the first heat source side heat exchanger 12*a* and the second heat source side heat exchanger 12*b* are connected to each other in parallel through which the refrigerant flows, which can reduce pressure loss and keep the saturation temperature of the evaporators high so that the saturation temperatures at the outlets/inlets of the evaporators are higher than 0 degrees C., for example. Thus, to achieve a certain amount of heat exchange, when outdoor air containing water is subjected to heat exchange in the evaporators, no water can condense on the fins and the heat transfer pipes of the evaporators, preventing frost formation, compared to a case where the first heat source side heat exchanger 12*a* and the second heat source side heat exchanger 12*b* are connected to each other in series through which refrigerant flows.

[Defrosting Operation Mode]

The defrosting operation mode is implemented when the detection result of the third temperature sensor 48, which is disposed on the outlet side of the first heat source side heat exchanger 12*a* and the second heat source side heat exchanger 12*b* in the heating operation mode, is less than or equal to a predetermined value. That is, when the heating operation mode is implemented and the detection result of the third temperature sensor 48 is less than or equal to a predetermined value (e.g., less than or equal to about −10 degrees C.), the controller 60 determines that a predetermined amount of frost has formed on the fins in the first heat source side heat exchanger 12*a* and the second heat source side heat exchanger 12*b*, and implements a defrosting operation mode.

The occurrence of frost formation may be determined when, for example, a saturation temperature obtained by converting a suction pressure, which is a value detected by the low pressure sensor 49 disposed in a suction unit of the compressor 10, greatly decreases compared with a preset outside air temperature or when a certain time has elapsed with the temperature difference between the outside air temperature and the evaporating temperature kept greater than or equal to a preset value.

FIG. 2 is a refrigerant circuit diagram illustrating a flow of refrigerant in the cooling operation mode and the defrosting operation mode of the air-conditioning apparatus 100 according to Embodiment 1 of the present invention.

FIG. 2 illustrates a flow of refrigerant in the defrosting operation mode when, by way of example, frost has formed on the first heat source side heat exchanger 12*a* and the second heat source side heat exchanger 12*b*. In FIG. 2, the flow direction of the refrigerant is indicated by a solid line arrow.

As illustrated in FIG. 2, low-temperature, low-pressure refrigerant is compressed by the compressor 10 to high-temperature, high-pressure gas refrigerant which is discharged. The high-temperature, high-pressure gas refrigerant discharged from the compressor 10 flows into the first heat source side heat exchanger 12*a* via the refrigerant flow switching device 11 and the first header 14*a*. The flowing high-temperature, high-pressure gas refrigerant is then converted into high-pressure, medium-temperature gas or two-phase refrigerant by melting the frost on the first heat source side heat exchanger 12*a*. The high-pressure, medium-temperature gas or two-phase refrigerant, which has flowed out of the first heat source side heat exchanger 12*a*, flows into the second heat source side heat exchanger 12*b* via the second header 14*b*, the series pipe 6, the first opening and closing device 30, which is switched to the open state, and the third header 15*a*. The flowing high-pressure, medium-temperature gas or two-phase refrigerant is then converted into high-pressure, low-temperature gas, two-phase, or liquid refrigerant by melting the frost on the second heat source side heat exchanger 12*b*. The high-pressure, low-temperature gas, two-phase, or liquid refrigerant flows out of the outdoor unit 1 via the fourth header 15*b* and the third parallel pipe 9, travels through the main pipe 4, and flows into the indoor unit 2.

The second opening and closing device 31 remains closed, which prevents bypassing of the high-pressure, medium-temperature gas or two-phase refrigerant, which has flowed out of the first heat source side heat exchanger 12*a*, to the indoor unit 2. The third opening and closing device 32 remains closed, which prevents bypassing of the high-temperature, high-pressure gas refrigerant, which has been discharged from the compressor 10, to the second heat source side heat exchanger 12*b*.

That is, in the outdoor unit 1, the first heat source side heat exchanger 12*a* and the second heat source side heat exchanger 12*b* are connected to each other in series by a series refrigerant flow path.

The series refrigerant flow path is established, when the first heat source side heat exchanger 12*a* and the second heat source side heat exchanger 12*b* are used as condensers, with the first opening and closing device 30 opened, the second opening and closing device 31 closed, and the third opening and closing device 32 closed.

In the indoor unit 2, the high-pressure liquid refrigerant is expanded into low-pressure, low-temperature gas, two-phase, or liquid refrigerant in a two-phase gas-liquid state by the load side expansion device 22, which is fully opened or whose opening degree is increased. The refrigerant flows into the load side heat exchanger 21, flows out of the load side heat exchanger 21 after exchanging heat, travels through the main pipe 4, and flows into the outdoor unit 1 again. The refrigerant, which has flowed into the outdoor unit 1, travels through the refrigerant flow switching device 11 and is sucked into the compressor 10 again.

At this time, a fan (not illustrated) in the indoor unit 2 is not in operation, which prevents cold air from being supplied indoors.

The defrosting of the first heat source side heat exchanger 12*a* and the second heat source side heat exchanger 12*b* is determined to be completed in the following way. For example, when a predetermined time has elapsed or when the temperature of the third temperature sensor 48 becomes equal to or higher than a predetermined value (e.g., 5 degrees C., etc.), the frost may be determined to have melted. The predetermined time may be set to a predetermined time or longer until all the frost has melted when a portion of the high-temperature, high-pressure refrigerant flows into the first heat source side heat exchanger 12*a* and the second heat source side heat exchanger 12*b*, assuming that frost has formed such that it covers the first heat source side heat exchanger 12*a* and the second heat source side heat exchanger 12*b* with no gaps being present.

[Advantageous Effects in Defrosting Operation Mode]

As described above, in the defrosting operation mode, refrigerant flows in the series refrigerant flow path such that the first heat source side heat exchanger 12*a* exchanges heat of the refrigerant and then causes the refrigerant to flow into the second heat source side heat exchanger 12*b* to perform defrosting. The refrigerant, which has flowed out of the first heat source side heat exchanger 12*a*, is supplied to the second heat source side heat exchanger 12*b* via the second header 14*b*, which includes a header main pipe 50 and a plurality of larger and shorter branch pipes 51 than a plurality of narrow and long capillary tubes of a distributor. Thus, in Embodiment 1, pressure loss can be reduced and the temperature of high-pressure, medium-temperature gas or two-phase refrigerant, which flows into the second heat source side heat exchanger 12*b*, can be kept high, compared to a case when a distributor including a plurality of narrow and long capillary tubes is provided at the position of the second header 14*b*. This prevents a reduction in the defrosting capabilities of the second heat source side heat exchanger 12*b*. Thus, the use of a header can prevent frost from being left on the second heat source side heat exchanger 12*b*, compared to the use of a distributor including a plurality of narrow and long capillary tubes.

In Embodiment 1, both the second header 14*b* and the fourth header 15*b* are used as headers, by way of example, and the present invention is not limited thereto. In an exemplary configuration, only the second header 14*b* may be used as a header and the fourth header 15*b* may be used as a distributor including a plurality of narrow and long capillary tubes. Even in this case, the pressure loss of the refrigerant to be supplied to the second heat source side heat exchanger 12*b* can be reduced, and a reduction in defrosting capabilities can be prevented.

In Embodiment 1, the first heat source side heat exchanger 12*a* and the second heat source side heat exchanger 12*b* are connected to each other in series by a series refrigerant flow path, with the first opening and closing device 30 opened, the second opening and closing device 31 closed, and the third opening and closing device 32 closed, by way of example, and the present invention is not limited thereto. For example, the first opening and closing device 30, the second opening and closing device 31, and the third opening and closing device 32 are each used as a device capable of opening or closing a refrigerant flow path, such as a two-way valve, a solenoid valve, or an electronic expansion valve. Further, defrosting is also feasible when the first heat source side heat exchanger 12*a* and the second heat source side heat exchanger 12*b* are used as parallel refrigerant flows, with the first opening and closing device 30 closed, the second opening and closing device 31 opened, and the third opening and closing device 32 opened. This allows parallel flow paths to be established, which achieves higher defrosting capabilities than a series flow path, and can prevent frost from being left on the second heat source side heat exchanger 12*b*.

[Distribution Adjustment Header]

Figure 4:
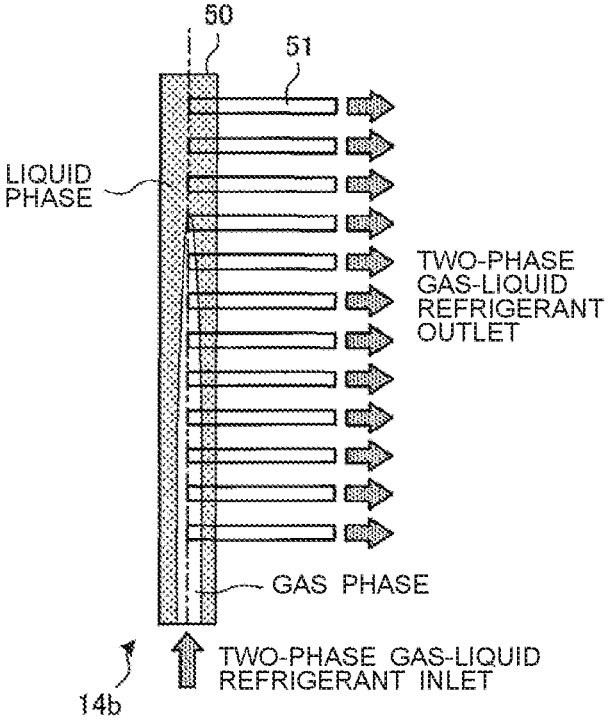
FIG. 4 is a schematic structural diagram illustrating an example of a distribution adjustment header according to Embodiment 1 of the present invention.

FIG. 4 is a schematic structural diagram illustrating an example of a distribution adjustment header according to Embodiment 1 of the present invention.

In the air-conditioning apparatus 100, the second header 14*b* and the fourth header 15*b* are arranged as distribution adjustment headers. A description will be made, taking the second header 14*b* as an example.

FIG. 4 illustrates the structure of the second header 14*b* and a distribution of two-phase refrigerant into the gas phase and the liquid phase.

The second header 14*b* serving as a distribution adjustment header includes the header main pipe 50 and the plurality of branch pipes 51. The plurality of branch pipes 51 are connected to the header main pipe 50 in such a manner as to protrude toward the inside of the header main pipe 50. The amounts of insertion of the plurality of branch pipes 51 that protrude toward the inside of the header main pipe 50 are all the same. Each of the plurality of branch pipes 51 has a larger pipe diameter and is shorter than a narrow capillary tube used in an existing distributor. It is assumed here that the number of branch pipes 51 is 12.

In the second header 14*b*, a lower portion of the header main pipe 50 is connected to the first parallel pipe 7. Thus, in the second header 14*b*, when the first heat source side heat exchanger 12*a* is used as an evaporator, two-phase gas-liquid refrigerant flows upward from the lower portion of the header main pipe 50.

When the first heat source side heat exchanger 12*a* and the second heat source side heat exchanger 12*b* are used as evaporators during the heating operation, the flows of the low-temperature, low-pressure two-phase refrigerant into the first heat source side heat exchanger 12*a* and the second heat source side heat exchanger 12*b* are annular flows or churn flows with a quality of about 0.05 to 0.30. In the low-temperature, low-pressure two-phase refrigerant, the gas phase is distributed in a center portion of the header main pipe 50 extending in the vertical direction and the liquid phase is distributed in an annular portion around the center portion.

Due to the flow pattern described above, the protrusion of the plurality of branch pipes 51 toward the inside of the header main pipe 50 allows a large amount of gas refrigerant to be distributed to the branch pipes 51 in a lower portion of the second header 14*b*. In an upper portion of the second header 14*b*, a large amount of liquid refrigerant is distributed to the branch pipes 51. This facilitates distribution of a required amount of liquid refrigerant for each refrigerant flow path in the first heat source side heat exchanger 12*a*.

Accordingly, a problem specific to a header, such as no liquid refrigerant flowing in an upper portion of the second header 14*b* due to gravity, can be overcome. Further, since a required amount of liquid refrigerant for each refrigerant flow path can be distributed, the performance of the evaporator can be improved, like a distributor that adjusts the distribution of refrigerant through adjustment of the magnitude of the pipe friction loss by changing the pipe diameter or length of a capillary tube.

The fourth header 15*b* can also achieve similar advantages.

In particular, when the fan 16 is a top-flow fan that is positioned above the first heat source side heat exchanger 12*a* and the second heat source side heat exchanger 12*b*, an air velocity distribution is generated across the first heat source side heat exchanger 12*a* and the second heat source side heat exchanger 12*b* from the upper ends to the lower ends thereof, with the air velocity in the refrigerant flow path on the upper end side higher than the air velocity in the refrigerant flow path on the lower end side. Further, the amount of heat exchange in the refrigerant flow path on the upper end side is larger than the amount of heat exchange in the refrigerant flow path on the lower end side. Thus, when the first heat source side heat exchanger 12*a* and the second heat source side heat exchanger 12*b* are used as evaporators, a larger amount of liquid refrigerant is caused to flow through the refrigerant flow path on the upper portion side, thus enabling supply of a required amount of refrigerant in accordance with the air velocity distribution in each refrigerant flow path in the first heat source side heat exchanger 12*a* and the second heat source side heat exchanger 12*b*. This facilitates more efficient use of the evaporators and improvement in the performance of the evaporators.

In Embodiment 1, as illustrated in FIG. 4, the structure of a distribution adjustment header in which 12 branch pipes 51 are connected to the header main pipe 50 has been described, by way of example, and the present invention is not limited thereto. A required number of branch pipes 51 may be disposed in accordance with each refrigerant flow path in the first heat source side heat exchanger 12*a* or the second heat source side heat exchanger 12*b*.

Figure 5:
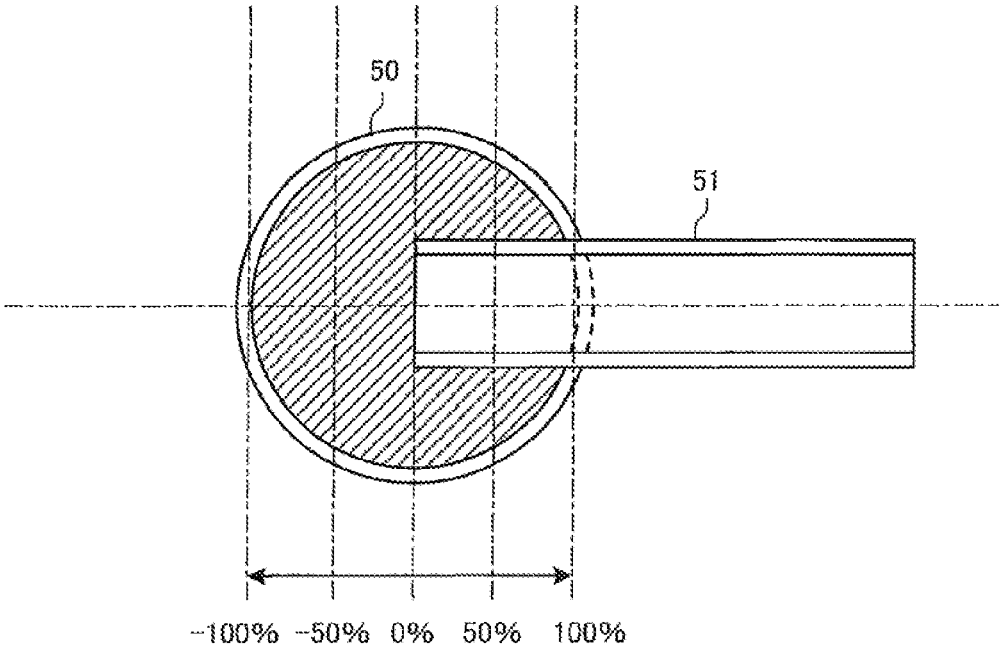
FIG. 5 is a schematic explanatory diagram illustrating how a branch pipe of the distribution adjustment header according to Embodiment 1 of the present invention is inserted into a header main pipe.

FIG. 5 is a schematic explanatory diagram illustrating how the branch pipes 51 of the distribution adjustment header according to Embodiment 1 of the present invention are inserted into the header main pipe 50. In FIG. 5, a change of the amount of insertion is expressed as a percentage of the radius of the header main pipe 50, with 0% representing the position of insertion when the leading end of each of the plurality of branch pipes 51 reaches the center portion of the header main pipe 50.

Figure 6:
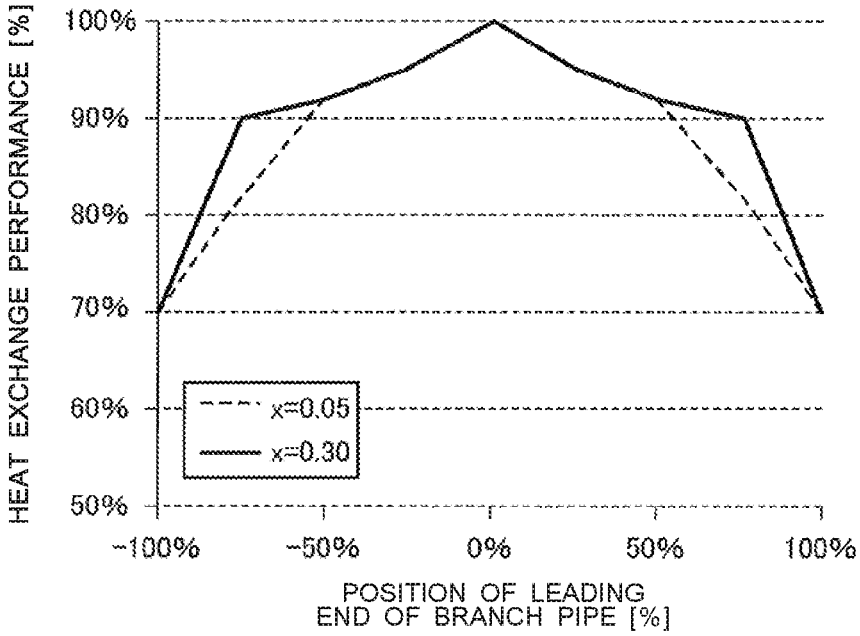
FIG. 6 is a diagram illustrating relationships of changes in the performance of an evaporator with changes in the amount of insertion of the branch pipe into the header main pipe of the distribution adjustment header according to Embodiment 1 of the present invention.

FIG. 6 is a diagram illustrating relationships of changes in the performance of an evaporator with changes in the amount of insertion of the branch pipes 51 into the header main pipe 50 of the distribution adjustment header according to Embodiment 1 of the present invention.

As illustrated in FIG. 6, the changes in the performance of the evaporator indicate that the evaporator exhibits maximum performance when the leading ends of the plurality of branch pipes 51 are located in the center portion of the header main pipe 50.

When the amounts of insertion of the leading ends of the plurality of branch pipes 51 are located at a position within ±50% of the radius of the header main pipe 50 from the center portion of the header main pipe 50, a reduction in the performance of the evaporator can be prevented.

In contrast, if the amounts of insertion of the leading ends of the plurality of branch pipes 51 are located at a position closer to the negative side than the position equal to −50% of the radius of the header main pipe 50 from the center portion of the header main pipe 50, that is, if the leading ends of the plurality of branch pipes 51 are located at a position less than 50% of the inner radius of the header main pipe 50 from an inner wall portion of the header main pipe 50 on the side thereof in the direction in which the plurality of branch pipes 51 are inserted, when the first heat source side heat exchanger 12*a* and the second heat source side heat exchanger 12*b* are used as evaporators, the amounts of insertion of the plurality of branch pipes 51 are excessively large, resulting in an increase in pressure loss and deterioration of the performance of the evaporators.

Further, if the amounts of insertion of the leading ends of the plurality of branch pipes 51 are located at a position greater than 50% of the radius of the header main pipe 50 from the center portion of the header main pipe 50, that is, if the leading ends of the plurality of branch pipes 51 are located at a position less than 50% of the inner radius of the header main pipe 50 from the inner wall portion of the header main pipe 50 on the side thereof from which the plurality of branch pipes 51 are inserted, when the first heat source side heat exchanger 12*a* and the second heat source side heat exchanger 12*b* are used as evaporators, the amounts of insertion of the plurality of branch pipes 51 are excessively small, resulting in the failure to distribute a large amount of gas refrigerant to the branch pipes 51 in a lower portion of the second header 14*b*. As a result, gas refrigerant is also distributed to the branch pipes 51 in an upper portion of the second header 14*b*. This prevents distribution of a required amount of liquid refrigerant in each refrigerant flow path. As a result, the performance of the evaporators deteriorates.

From the above, it is thus desirable that the leading ends of the plurality of branch pipes 51 protruding toward the inside of the header main pipe 50 be located between the position equal to 50% of the inner radius of the header main pipe 50 from the inner wall portion of the header main pipe 50 on the side thereof in the direction in which the plurality of branch pipes 51 are inserted and the position equal to 50% of the inner radius of the header main pipe 50 from the inner wall portion of the header main pipe 50 on the side thereof from which the plurality of branch pipes 51 are inserted. When the leading ends are in this range, a reduction in the performance of the evaporators can be prevented.

As apparent from FIG. 6, furthermore, more preferably, the leading ends of the plurality of branch pipes 51 are located at the position equal to 0% at which the leading ends of the plurality of branch pipes 51 reach the center portion of the header main pipe 50, that is, the leading ends of the plurality of branch pipes 51 protruding toward the inside of the header main pipe 50 are located in the center portion of the header main pipe 50. In this case, the evaporator exhibits maximum performance.

Advantageous Effects of Embodiment 1

According to Embodiment 1, the air-conditioning apparatus 100 includes a main circuit in which the compressor 10, the refrigerant flow switching device 11, the load side heat exchanger 21, the load side expansion device 22, the first heat source side heat exchanger 12*a*, and the second heat source side heat exchanger 12*b* are sequentially connected by the refrigerant pipe 3 and in which refrigerant circulates. In the air-conditioning apparatus 100, when the first heat source side heat exchanger 12*a* and the second heat source side heat exchanger 12*b* are used as condensers, the first heat source side heat exchanger 12*a* and the second heat source side heat exchanger 12*b* are connected to each other in series by a series refrigerant flow path. When the first heat source side heat exchanger 12*a* and the second heat source side heat exchanger 12*b* are used as evaporators, the first heat source side heat exchanger 12*a* and the second heat source side heat exchanger 12*b* are connected to each other in parallel by a parallel refrigerant flow path. The second header 14*b*, which adjusts distribution of the refrigerant, is disposed at a position in the refrigerant flow path on the inlet side of the first heat source side heat exchanger 12*a* when the first heat source side heat exchanger 12*a* and the second heat source side heat exchanger 12*b* are used as evaporators. Further, the fourth header 15*b*, which adjusts distribution of the refrigerant, is disposed at a position in the refrigerant flow path on the inlet side of the second heat source side heat exchanger 12*b* when the first heat source side heat exchanger 12*a* and the second heat source side heat exchanger 12*b* are used as evaporators.

According to this configuration, the second header 14*b* and the fourth header 15*b* are disposed as distribution adjustment headers. Thus, instead of a narrow and long capillary tube which is an existing distributor, a distribution adjustment header is provided at a position in the refrigerant flow path on the outlet side of each of the first heat source side heat exchanger 12*a* and the second heat source side heat exchanger 12*b* when the first heat source side heat exchanger 12*a* and the second heat source side heat exchanger 12*b* are used as condensers. This can reduce pressure loss, resulting in an improvement in the performance of the condensers. In addition, a distribution adjustment header is provided at a position in the refrigerant flow path on the inlet side of each of the first heat source side heat exchanger 12*a* and the second heat source side heat exchanger 12*b* when the first heat source side heat exchanger 12*a* and the second heat source side heat exchanger 12*b* are used as evaporators. This allows required refrigerant to be uniformly distributed from the distribution adjustment header in accordance with the heat transfer area of each of the first heat source side heat exchanger 12*a* and the second heat source side heat exchanger 12*b* and in accordance with the air velocity distribution in the stage direction of the heat exchanger. Thus, the performance of the evaporators is improved. Additionally, no flowing of refrigerant more than the processing capabilities of the evaporators can prevent frost formation. Accordingly, a reduction in refrigeration cycle efficiency is prevented, thereby enabling an improvement in power-saving performance. In addition, the prevention of frost formation can ensure comfort in indoor environment.

According to Embodiment 1, the distribution adjustment headers used for the second header 14*b* and the fourth header 15*b* are disposed at positions in the refrigerant flow path on the inlet side of all of the first heat source side heat exchanger 12*a* and the second heat source side heat exchanger 12*b*, when the first heat source side heat exchanger 12*a* and the second heat source side heat exchanger 12*b* are used as evaporators.

According to this configuration, in all of the first heat source side heat exchanger 12*a* and the second heat source side heat exchanger 12*b*, the performance of the condensers can be improved and the performance of the evaporators can be improved.

According to Embodiment 1, each of the distribution adjustment headers used for the second header 14*b* and the fourth header 15*b* includes the header main pipe 50 connected to the refrigerant pipe 3 in the main circuit, and the plurality of branch pipes 51, each of which is connected to a corresponding one of the heat transfer pipes, which are elements constituting the heat exchanger. The plurality of branch pipes 51 protrude toward the inside of the header main pipe 50.

According to this configuration, when the first heat source side heat exchanger 12*a* and the second heat source side heat exchanger 12*b* are used as evaporators during the heating operation, the flows of low-temperature, low-pressure two-phase refrigerant into the first heat source side heat exchanger 12*a* and the second heat source side heat exchanger 12*b* are annular flows or churn flows with a quality of about 0.05 to 0.30. In the low-temperature, low-pressure two-phase refrigerant, the gas phase is distributed in a center portion of the header main pipe 50 and the liquid phase is distributed in an annular portion surrounding the center portion. Due to the flow pattern described above, the protrusion of the plurality of branch pipes 51 toward the inside of the header main pipe 50 allows a large amount of gas refrigerant to be distributed to the branch pipes 51 in a lower portion of the second header 14*b*. In an upper portion of the second header 14*b*, a large amount of liquid refrigerant is distributed to the branch pipes 51. This facilitates distribution of a required amount of liquid refrigerant for each refrigerant flow path.

Each of the plurality of branch pipes 51 has a larger pipe diameter and is shorter than a narrow capillary tube used in a distributor. Thus, when the first heat source side heat exchanger 12*a* and the second heat source side heat exchanger 12*b* are used as condensers, pressure loss can be reduced, and the performance of the condensers can be improved.

According to Embodiment 1, the heat transfer pipes are flat pipes.

According to this configuration, the heat transfer pipes are each configured to have a flat cross section, which can increase the contact area of the heat transfer pipes with the outdoor air without increasing airflow resistance. Thus, even when the size of the first heat source side heat exchanger 12*a* and the second heat source side heat exchanger 12*b* is reduced, sufficient heat exchanger performance can be obtained.

According to Embodiment 1, the leading ends of the plurality of branch pipes 51 protruding toward the inside of the header main pipe 50 are located between a position equal to 50% of the inner radius of the header main pipe 50 from an inner wall portion of the header main pipe 50 on the side thereof in the direction in which the plurality of branch pipes 51 are inserted and a position equal to 50% of the inner radius of the header main pipe 50 from the inner wall portion of the header main pipe 50 on the side thereof from which the plurality of branch pipes 51 are inserted.

According to this configuration, if the leading ends of the plurality of branch pipes 51 are at a position greater than or equal to 50% of the inner radius of the header main pipe 50 from the inner wall portion of the header main pipe 50 on the side thereof in the direction in which the plurality of branch pipes 51 are inserted, when the first heat source side heat exchanger 12*a* and the second heat source side heat exchanger 12*b* are used as evaporators, the amounts of insertion of the plurality of branch pipes 51 are not excessively large. Pressure loss is not deteriorated, and a lowering in the performance of the evaporators can be prevented. In addition, if the leading ends of the plurality of branch pipes 51 are at a position greater than or equal to 50% of the inner radius of the header main pipe 50 from the inner wall portion of the header main pipe 50 on the side thereof from which the plurality of branch pipes 51 are inserted, when the first heat source side heat exchanger 12*a* and the second heat source side heat exchanger 12*b* are used as evaporators, the amounts of insertion of the plurality of branch pipes 51 are not excessively small. A large amount of gas refrigerant can be distributed to the branch pipes 51 in lower portions of the second header 14*b* and the fourth header, and liquid refrigerant is distributed to the branch pipes 51 in upper portions of the second header 14*b* and the fourth header. This allows distribution of a required amount of liquid refrigerant for each refrigerant flow path. Thus, the performance of the evaporators can be improved.

As described above, the use of a distribution adjustment header can distribute two-phase refrigerant to each refrigerant flow path in an evaporator in a way similar to that of a distributor, unlike the use of a typical header in which the amounts of insertion of branch pipes into a header main pipe are not adjusted, and can improve the performance of the evaporators. Therefore, the refrigeration cycle efficiency can be improved.

According to Embodiment 1, the leading ends of the plurality of branch pipes 51 protruding toward the inside of the header main pipe 50 are located in a center portion of the header main pipe 50.

According to this configuration, when the first heat source side heat exchanger 12*a* and the second heat source side heat exchanger 12*b* are used as evaporators, the amounts of insertion of the plurality of branch pipes 51 are optimum. A large amount of gas refrigerant can be favorably distributed to the branch pipes 51 in lower portions of the second header 14*b* and the fourth header 15*b*, and liquid refrigerant is favorably distributed to the branch pipes 51 in upper portions of the second header 14*b* and the fourth header 15*b*. This enables most preferable distribution of a required amount of liquid refrigerant for each refrigerant flow path. Thus, the performance of the evaporators is maximally improved.

According to Embodiment 1, the header main pipe 50 extends in the vertical direction. The plurality of branch pipes 51 are arranged in parallel to each other in the vertical direction and extend in the horizontal direction.

According to this configuration, when the first heat source side heat exchanger 12*a* and the second heat source side heat exchanger 12*b* are used as evaporators, in each of the second header 14*b* and the fourth header 15*b*, two-phase gas-liquid refrigerant flows upward from a lower portion of the header main pipe 50. The flow of the low-temperature, low-pressure two-phase refrigerant is an annular flow or a churn flow at a quality of about 0.05 to 0.30. In the low-temperature, low-pressure two-phase refrigerant, the gas phase is distributed in a center portion of the header main pipe 50 extending in the vertical direction and the liquid phase is distributed in an annular portion around the center portion. Due to the flow pattern described above, the protrusion of the plurality of branch pipes 51 toward the inside of the header main pipe 50 allows a large amount of gas refrigerant to be distributed to the branch pipes 51 in a lower portion of each of the second header 14*b* and the fourth header 15*b*. In an upper portion of each of the second header 14*b* and the fourth header 15*b*, a large amount of liquid refrigerant is distributed to the branch pipes 51. This facilitates distribution of a required amount of liquid refrigerant for each refrigerant flow path. Accordingly, a problem specific to a header, such as no liquid refrigerant flowing in upper portions of the second header 14*b* and the fourth header 15*b* due to gravity, can be overcome. Further, since a required amount of liquid refrigerant for each refrigerant flow path can be distributed, the performance of the evaporators can be improved, like a distributor that adjusts the distribution of refrigerant through adjustment of the magnitude of the pipe friction loss by changing the pipe diameter or length of a capillary tube.

According to Embodiment 1, a lower portion of the header main pipe 50 is connected to the refrigerant pipe 3 in the main circuit.

According to this configuration, when the first heat source side heat exchanger 12*a* and the second heat source side heat exchanger 12*b* are used as evaporators, in each of the second header 14*b* and the fourth header 15*b*, two-phase gas-liquid refrigerant can flow upward from the lower portion of the header main pipe 50.

According to Embodiment 1, the first heat source side heat exchanger 12*a* is formed to have a larger heat transfer area than the heat transfer area of the second heat source side heat exchanger 12*b*.

According to this configuration, the number of refrigerant flow paths in the first heat source side heat exchanger 12*a* is larger than the number of refrigerant flow paths in the second heat source side heat exchanger 12*b*. Thus, in the first heat source side heat exchanger 12*a*, high-pressure gas refrigerant transfers heat to the outdoor air and is converted into two-phase refrigerant or saturated liquid refrigerant with low quality, for example, about 0.01 to 0.3, in accordance with the temperature of the outdoor air at that time, which then flows out of the first heat source side heat exchanger 12*a*. Alternatively, in the first heat source side heat exchanger 12*a*, high-pressure gas refrigerant transfers heat to the outdoor air and is brought into a state in which the subcool (the degree of subcooling), which is the difference between the saturated liquid temperature of the liquid refrigerant and the liquid temperature at the outlet of the first heat source side heat exchanger 12*a*, is low, for example, less than 2 degrees C., which then flows out of the first heat source side heat exchanger 12*a*. Thereafter, the majority of the high-pressure refrigerant, which transfers heat to the outdoor air in the second heat source side heat exchanger 12*b*, is converted into liquid refrigerant having a lower heat transfer coefficient than the two-phase refrigerant. In this case, the number of refrigerant flow paths in the second heat source side heat exchanger 12*b* is smaller than the number of refrigerant flow paths in the first heat source side heat exchanger 12*a*. This can increase the refrigerant flow speed of the liquid refrigerant and increase the heat transfer coefficient of the liquid refrigerant compared to a case when the number of refrigerant flow paths in the second heat source side heat exchanger 12*b* is the same as the number of refrigerant flow paths in the first heat source side heat exchanger 12*a*. Therefore, the performance of the condensers is improved.

According to Embodiment 1, a portion of the first heat source side heat exchanger 12*a* and the second heat source side heat exchanger 12*b* are integrally formed in such a manner as to share a fin, which is an element constituting the heat exchanger. A remaining portion other than the portion of the first heat source side heat exchanger 12*a* is formed as parts separated from the heat source side heat exchanger 12*b*.

According to this configuration, a portion of the first heat source side heat exchanger 12*a* and the second heat source side heat exchanger 12*b* are integrally formed in such a manner as to share a fin, which is an element constituting the heat exchanger. This can achieve a reduction in the size of the first heat source side heat exchanger 12*a* and the second heat source side heat exchanger 12*b*.

According to Embodiment 1, the air-conditioning apparatus 100 includes a heat exchanger flow switching device that switches between the series refrigerant flow path and the parallel refrigerant flow path. The heat exchanger flow switching device includes the first opening and closing device 30, the second opening and closing device 31, and the third opening and closing device 32. The first opening and closing device 30 is arranged in the series pipe 6, which couples the first heat source side heat exchanger 12*a* and the second heat source side heat exchanger 12*b* together in series, and is configured to permit or block the passage of the refrigerant through the series pipe 6. The second opening and closing device 31 is arranged in the first parallel pipe 7, which couples the first heat source side heat exchanger 12*a* and the load side expansion device 22 together, and is configured to permit or block the passage of the refrigerant through the first parallel pipe 7. The third opening and closing device 32 is arranged in the second parallel pipe 8, which couples the refrigerant flow switching device 11 and the second heat source side heat exchanger 12*b* together, and is configured to permit or block the passage of the refrigerant through the second parallel pipe 8. In the heat exchanger flow switching device, when the first heat source side heat exchanger 12*a* and the second heat source side heat exchanger 12*b* are used as condensers, the series refrigerant flow path is established with the first opening and closing device 30 opened, the second opening and closing device 31 closed, and the third opening and closing device 32 closed. In the heat exchanger flow switching device, when the first heat source side heat exchanger 12*a* and the second heat source side heat exchanger 12*b* are used as evaporators, the parallel refrigerant flow path is established with the first opening and closing device 30 closed, the second opening and closing device 31 opened, and the third opening and closing device 32 opened.

According to this configuration, when the first heat source side heat exchanger 12*a* and the second heat source side heat exchanger 12*b* are used as condensers, the first heat source side heat exchanger 12*a* and the second heat source side heat exchanger 12*b* can be connected to each other in series by a series refrigerant flow path. When the first heat source side heat exchanger 12*a* and the second heat source side heat exchanger 12*b* are used as evaporators, the first heat source side heat exchanger 12*a* and the second heat source side heat exchanger 12*b* can be connected to each other in parallel by a parallel refrigerant flow path.

According to Embodiment 1, the third opening and closing device 32 may be formed of a backflow prevention device that prevents the refrigerant from flowing into the flow path on the inlet side of the second heat source side heat exchanger 12*b* from the flow path on the inlet side of the first heat source side heat exchanger 12*a* through the second parallel pipe 8 when the first heat source side heat exchanger 12*a* and the second heat source side heat exchanger 12*b* are used as condensers.

Due to this configuration, the third opening and closing device 32 allows refrigerant to flow from the flow path on the outlet side of the second heat source side heat exchanger 12*b* to the flow path on the outlet side of the first heat source side heat exchanger 12*a* in the second parallel pipe 8 and allows the flow of refrigerant from the flow path on the outlet side of the second heat source side heat exchanger 12*b* to join with a flow of refrigerant from the flow path on the outlet side of the first heat source side heat exchanger 12*a* in the primary pipe 5 only when the first heat source side heat exchanger 12*a* and the second heat source side heat exchanger 12*b* are used as evaporators.

According to Embodiment 1, the air-conditioning apparatus 100 includes a main circuit in which the compressor 10, the refrigerant flow switching device 11, the load side heat exchanger 21, the load side expansion device 22, the first heat source side heat exchanger 12*a*, and the second heat source side heat exchanger 12*b* are sequentially connected by a pipe and in which refrigerant circulates. In the air-conditioning apparatus 100, when the first heat source side heat exchanger 12*a* and the second heat source side heat exchanger 12*b* are used as condensers, the first heat source side heat exchanger 12*a* and the second heat source side heat exchanger 12*b* are connected to each other in series by a series refrigerant flow path. In the air-conditioning apparatus 100, when the first heat source side heat exchanger 12*a* and the second heat source side heat exchanger 12*b* are used as evaporators, the first heat source side heat exchanger 12*a* and the second heat source side heat exchanger 12*b* are connected to each other in parallel by a parallel refrigerant flow path. The second header 14*b* is disposed at least at a position in the refrigerant flow path on the outlet side of the first heat source side heat exchanger 12*a* when the first heat source side heat exchanger 12*a* and the second heat source side heat exchanger 12*b* are defrosted.

Due to this configuration, refrigerant, which has flowed out of the first heat source side heat exchanger 12*a*, is supplied to the second heat source side heat exchanger 12*b* via the second header 14*b*, which includes the header main pipe 50 and the plurality of larger and shorter branch pipes 51 than a plurality of narrow and long capillary tubes of a distributor. Thus, pressure loss can be reduced, and the temperature of high-pressure, medium-temperature gas or two-phase refrigerant, which flows into the second heat source side heat exchanger 12*b*, can be kept high, compared to a case when a distributor including a plurality of narrow and long capillary tubes is provided as the position of the second header 14*b*. This prevents a reduction in the defrosting capabilities of the second heat source side heat exchanger 12*b*. Thus, the use of a header can prevent frost from being left on the second heat source side heat exchanger 12*b*, compared to the use of a distributor including a plurality of narrow and long capillary tubes.

The second header 14*b* and the fourth header 15*b* are headers for distribution adjustment. The second header 14*b* and the fourth header 15*b*, each of which is a header for distribution adjustment, are disposed at positions in the refrigerant flow path on the inlet side of all of the first heat source side heat exchanger 12*a* and the second heat source side heat exchanger 12*b*, when the first heat source side heat exchanger 12*a* and the second heat source side heat exchanger 12*b* are used as evaporators.

Due to this configuration, in all of the first heat source side heat exchanger 12*a* and the second heat source side heat exchanger 12*b*, the performance of the condensers can be improved and the performance of the evaporators can be improved.

According to Embodiment 1, the air-conditioning apparatus 100 includes a heat exchanger flow switching device that switches between the series refrigerant flow path and the parallel refrigerant flow path. The heat exchanger flow switching device includes the first opening and closing device 30, the second opening and closing device 31, and the third opening and closing device 32. The first opening and closing device 30 is arranged in the series pipe 6, which couples the first heat source side heat exchanger 12*a* and the second heat source side heat exchanger 12*b* together in series, and is configured to permit or block the passage of the refrigerant through the series pipe 6. The second opening and closing device 31 is arranged in the first parallel pipe 7, which couples the first heat source side heat exchanger 12*a* and the load side expansion device 22 together, and is configured to permit or block the passage of the refrigerant through the first parallel pipe 7. The third opening and closing device 32 is arranged in the second parallel pipe 8, which couples the refrigerant flow switching device 11 and the second heat source side heat exchanger 12*b* together, and is configured to permit or block the passage of the refrigerant through the second parallel pipe 8. In the heat exchanger flow switching device, when the first heat source side heat exchanger 12*a* and the second heat source side heat exchanger 12*b* are used as condensers or are defrosted, the series refrigerant flow path is established with the first opening and closing device 30 opened, the second opening and closing device 31 closed, and the third opening and closing device 32 closed. In the heat exchanger flow switching device, when the first heat source side heat exchanger 12*a* and the second heat source side heat exchanger 12*b* are used as evaporators, the parallel refrigerant flow path is established with the first opening and closing device 30 closed, the second opening and closing device 31 opened, and the third opening and closing device 32 opened.

Due to this configuration, when the first heat source side heat exchanger 12*a* and the second heat source side heat exchanger 12*b* are used as condensers or are defrosted, the first heat source side heat exchanger 12*a* and the second heat source side heat exchanger 12*b* can be connected to each other in series by a series refrigerant flow path. When the first heat source side heat exchanger 12*a* and the second heat source side heat exchanger 12*b* are used as evaporators, the first heat source side heat exchanger 12*a* and the second heat source side heat exchanger 12*b* can be connected to each other in parallel by a parallel refrigerant flow path.

According to Embodiment 1, the air-conditioning apparatus 100 includes a heat exchanger flow switching device that switches between the series refrigerant flow path and the parallel refrigerant flow path. The heat exchanger flow switching device includes the first opening and closing device 30, the second opening and closing device 31, the third opening and closing device 32, and the controller 60. The first opening and closing device 30 is arranged in the series pipe 6, which couples the first heat source side heat exchanger 12*a* and the second heat source side heat exchanger 12*b* together in series, and is configured to permit or block the passage of the refrigerant through the series pipe 6. The second opening and closing device 31 is arranged in the first parallel pipe 7, which couples the first heat source side heat exchanger 12*a* and the load side expansion device 22 together, and is configured to permit or block the passage of the refrigerant through the first parallel pipe 7. The third opening and closing device 32 is arranged in the second parallel pipe 8, which couples the refrigerant flow switching device 11 and the second heat source side heat exchanger 12*b* together, and is configured to permit or block the passage of the refrigerant through the second parallel pipe 8. The controller 60 controls the opening degree or opening and closing of the first opening and closing device 30, the opening degree or opening and closing of the second opening and closing device 31, and the opening degree or opening and closing of the third opening and closing device 32. In the heat exchanger flow switching device, when the first heat source side heat exchanger 12*a* and the second heat source side heat exchanger 12*b* are defrosted, the controller 60 causes the first opening and closing device 30 to be closed, the second opening and closing device 31 to be opened, and the third opening and closing device 32 to be opened.

According to this configuration, when the first heat source side heat exchanger 12*a* and the second heat source side heat exchanger 12*b* are defrosted, the controller 60 causes the first opening and closing device 30 to be closed, the second opening and closing device 31 to be opened, and the third opening and closing device 32 to be opened, and the first heat source side heat exchanger 12*a* and the second heat source side heat exchanger 12*b* can be connected to each other in parallel by a parallel refrigerant flow path.

In Embodiment 1, two heat source side heat exchangers, namely, the first heat source side heat exchanger 12*a* and the second heat source side heat exchanger 12*b*, are used as a plurality of heat source side heat exchangers, by way of example, and the present invention is not limited thereto. Additionally, a plurality of heat source side heat exchangers having similar configurations may also be used. In this case, advantageous effects similar to those of Embodiment 1 can be obtained.

In Embodiment 1, furthermore, only the second header 14*b* and the fourth header 15*b* are used as distribution adjustment headers, by way of example, and the present invention is not limited thereto. In addition to the second header 14*b* and the fourth header 15*b*, the first header 14*a* and the third header 15*a* may also be implemented as distribution adjustment headers. Alternatively, either the second header 14*b* or the fourth header 15*b* may be implemented as a distribution adjustment header.

If a plurality of heat source side heat exchangers other than the first heat source side heat exchanger 12*a* and the second heat source side heat exchanger 12*b* are further used, a distribution adjustment header may be provided at a position in the refrigerant flow path on the inlet side of each of the plurality of heat source side heat exchangers when the plurality of heat source side heat exchangers are used as evaporators.

Further, the heat exchanger flow switching device includes a single first opening and closing device 30, a single second opening and closing device 31, and a single third opening and closing device 32, by way of example but not limitation. A plurality of first opening and closing devices 30, a plurality of second opening and closing devices 31, and a plurality of third opening and closing devices 32 may be disposed. In this case, advantages similar to those of Embodiment 1 can also be obtained.

Embodiment 2

Figure 7:
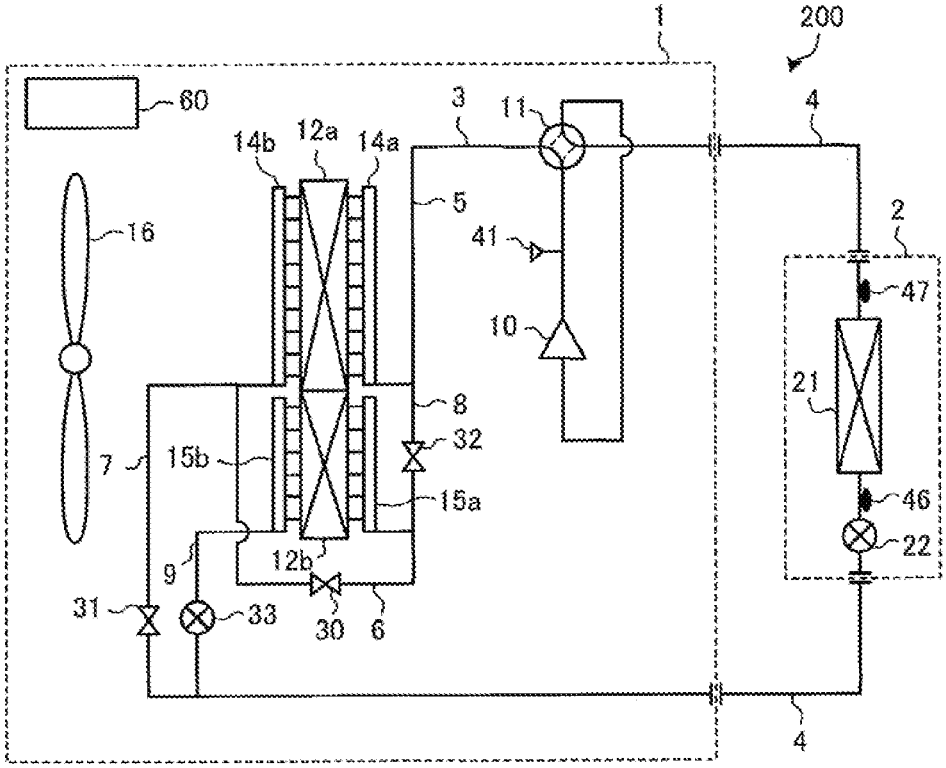
FIG. 7 is a schematic circuit configuration diagram illustrating an example circuit configuration of an air-conditioning apparatus according to Embodiment 2 of the present invention.

FIG. 7 is a schematic circuit configuration diagram illustrating an example circuit configuration of an air-conditioning apparatus 200 according to Embodiment 2 of the present invention. In FIG. 7, portions having the same configuration as those in the air-conditioning apparatus 100 in FIG. 1 are denoted by the same numerals, with a description thereof omitted. The air-conditioning apparatus 200 illustrated in FIG. 7 is different from FIG. 1 in the configuration of the outdoor unit 1.

In the outdoor unit 1 of the air-conditioning apparatus 200, the third parallel pipe 9 is provided with a fourth opening and closing device 33.

The fourth opening and closing device 33 is arranged in the third parallel pipe 9 and is configured to permit or block the passage of the refrigerant through the third parallel pipe 9. That is, the fourth opening and closing device 33 is a flow control valve for adjusting the flow rate of the refrigerant that is to flow into the second heat source side heat exchanger 12*b* when the first heat source side heat exchanger 12*a* and the second heat source side heat exchanger 12*b* are used as evaporators in the heating operation mode. The fourth opening and closing device 33 is formed of, for example, an expansion device capable of adjusting the flow rate of the refrigerant by changing the opening degree thereof, such as an electronic expansion valve.

According to the configuration described above, when the first heat source side heat exchanger 12*a* and the second heat source side heat exchanger 12*b* are used as evaporators, the opening degree of the fourth opening and closing device 33 is reduced to adjust the flow rate of the refrigerant. This can reduce the flow rate of refrigerant that is to flow into the second heat source side heat exchanger 12*b* having a smaller heat transfer area than the first heat source side heat exchanger 12*a*, and can equally distribute the respective amounts of refrigerant that is to flow into the first heat source side heat exchanger 12*a* and the second heat source side heat exchanger 12*b*. Therefore, the performance of the evaporators can be improved.

Figure 8:
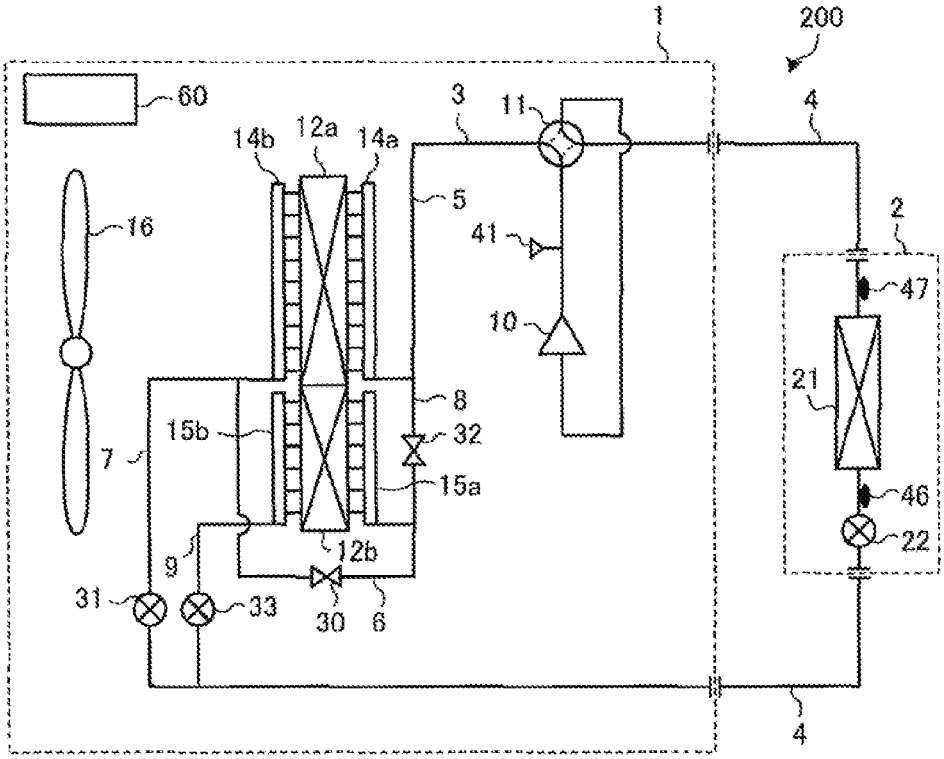
FIG. 8 is a schematic circuit configuration diagram illustrating an example modification of the circuit configuration of the air-conditioning apparatus according to Embodiment 2 of the present invention.

FIG. 8 is a schematic circuit configuration diagram illustrating an example modification of the circuit configuration of the air-conditioning apparatus 200 according to Embodiment 2 of the present invention.

In the modification illustrated in FIG. 8, the second opening and closing device 31 disposed in the first parallel pipe 7 is a flow control valve similar to the fourth opening and closing device 33. The second opening and closing device 31 is formed of an expansion device capable of adjusting the flow rate of the refrigerant by changing the opening degree thereof, such as an electronic expansion valve. The second opening and closing device 31 and the fourth opening and closing device 33 can adjust the respective opening degrees to uniformly distribute the respective amounts of refrigerant that is to flow into the first heat source side heat exchanger 12*a* and the second heat source side heat exchanger 12*b*.

In the illustrated modification, when the first heat source side heat exchanger 12*a* and the second heat source side heat exchanger 12*b* are used as condensers, a series refrigerant flow path is established with the second opening and closing device 31 closed and the fourth opening and closing device 33 opened.

When the first heat source side heat exchanger 12*a* and the second heat source side heat exchanger 12*b* are used as evaporators, a parallel refrigerant flow path is established such that the respective opening degrees of the second opening and closing device 31 and the fourth opening and closing device 33 are changed to adjust the flow rates of refrigerant that is to flow into the first heat source side heat exchanger 12*a* and the second heat source side heat exchanger 12*b*.

Advantageous Effects of Embodiment 2

According to Embodiment 2, the heat exchanger flow switching device includes the fourth opening and closing device 33. The fourth opening and closing device 33 is arranged in the third parallel pipe 9, which couples the second heat source side heat exchanger 12*b* and the load side expansion device 22 together, and is configured to permit or block the passage of the refrigerant through the third parallel pipe 9. The fourth opening and closing device 33 is an expansion device capable of adjusting a flow rate by changing the opening degree thereof.

Due to this configuration, when the first heat source side heat exchanger 12*a* and the second heat source side heat exchanger 12*b* are used as evaporators, the opening degree of the fourth opening and closing device 33 is reduced to adjust the flow rate of the refrigerant. This can reduce the flow rate of refrigerant that is to flow into the second heat source side heat exchanger 12*b* having a smaller heat transfer area than the first heat source side heat exchanger 12*a*, and can uniformly distribute the respective flow rates of refrigerant that is to flow into the first heat source side heat exchanger 12*a* and the second heat source side heat exchanger 12*b*. Therefore, the performance of the evaporators can be improved.

According to Embodiment 2, the second opening and closing device 31 is an expansion device capable of adjusting a flow rate by changing the opening degree thereof. In the heat exchanger flow switching device, when the first heat source side heat exchanger 12*a* and the second heat source side heat exchanger 12*b* are used as condensers, a series refrigerant flow path is established with the second opening and closing device 31 closed and the fourth opening and closing device 33 opened. When the first heat source side heat exchanger 12*a* and the second heat source side heat exchanger 12*b* are used as evaporators, a parallel refrigerant flow path is established such that the respective opening degrees of the second opening and closing device 31 and the fourth opening and closing device 33 are changed to adjust the flow rates of refrigerant that is to flow into the first heat source side heat exchanger 12*a* and the second heat source side heat exchanger 12*b*.

Due to this configuration, when the first heat source side heat exchanger 12*a* and the second heat source side heat exchanger 12*b* are used as evaporators, the second opening and closing device 31 and the fourth opening and closing device 33 can adjust the respective opening degrees to uniformly distribute the respective flow rates of refrigerant that is to flow into the first heat source side heat exchanger 12*a* and the second heat source side heat exchanger 12*b*.

Embodiment 3

Figure 9:
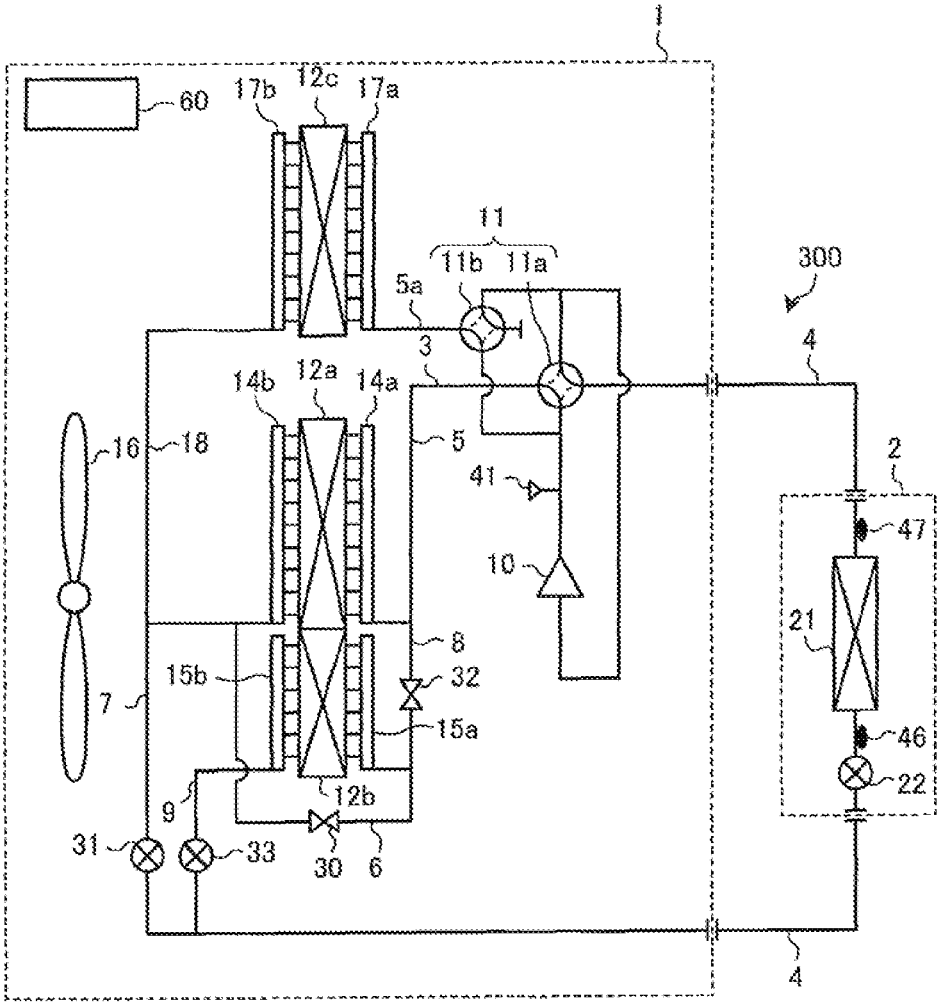
FIG. 9 is a schematic circuit configuration diagram illustrating an example circuit configuration of an air-conditioning apparatus according to Embodiment 3 of the present invention.

FIG. 9 is a schematic circuit configuration diagram illustrating an example circuit configuration of an air-conditioning apparatus 300 according to Embodiment 3 of the present invention. In Embodiment 3, differences from Embodiment 1 described above will be described, with the same portions as those in Embodiment 2 denoted by the same numerals. The air-conditioning apparatus 300 illustrated in FIG. 9 is different from the air-conditioning apparatus 200 illustrated in FIG. 8 in the configuration of the outdoor unit 1.

In the outdoor unit 1 of the air-conditioning apparatus 300, the first heat source side heat exchanger 12*a* and the second heat source side heat exchanger 12*b* are arranged vertically through a fin. In addition, a third heat source side heat exchanger 12*c* is arranged separately from the first heat source side heat exchanger 12*a* and the second heat source side heat exchanger 12*b*.

The third heat source side heat exchanger 12*c* has a configuration similar to that of the first heat source side heat exchanger 12*a*.

Further, the outdoor unit 1 of the air-conditioning apparatus 300 includes two refrigerant flow switching devices 11. A refrigerant flow switching device 11*a* is connected to the primary pipe 5, which is the refrigerant pipe 3 to be coupled to the first heat source side heat exchanger 12*a* and the second heat source side heat exchanger 12*b*. A refrigerant flow switching device 11*b* is connected to a second primary pipe 5*a*, which is the refrigerant pipe 3 to be coupled to the third heat source side heat exchanger 12*c*.

A fifth header 17*a* is disposed at a position in the refrigerant flow path on the inlet side of the third heat source side heat exchanger 12*c* when the third heat source side heat exchanger 12*c* is used as a condenser.

The fifth header 17*a* includes a header main pipe and a plurality of branch pipes.

The header main pipe extends in the vertical direction. The header main pipe is connected to the second primary pipe 5*a*, which is coupled to the refrigerant flow switching device 11*b*. A lower portion of the header main pipe is connected to the second primary pipe 5*a*.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the third heat source side heat exchanger 12*c*. The plurality of branch pipes are each a narrower pipe than the header main pipe.

The fifth header 17*a* allows the refrigerant to flow into or out of each of the heat transfer pipes of the third heat source side heat exchanger 12*c* through the branch pipe connected to the heat transfer pipe.

A sixth header 17*b* is disposed at a position in the refrigerant flow path on the inlet side of the third heat source side heat exchanger 12*c* when the third heat source side heat exchanger 12*c* is used as an evaporator.

The sixth header 17*b* includes a header main pipe and a plurality of branch pipes.

The header main pipe extends in the vertical direction. The header main pipe is connected to a fourth parallel pipe 18, which is coupled to the load side expansion device 22 via the first parallel pipe 7 and the main pipe 4. A lower portion of the header main pipe is connected to the fourth parallel pipe 18.

The plurality of branch pipes are arranged in parallel to each other in the vertical direction and extend in the horizontal direction. Each of the plurality of branch pipes is connected to a corresponding one of the heat transfer pipes, which are elements constituting the heat exchanger of the third heat source side heat exchanger 12*c*. The plurality of branch pipes are each a pipe narrower than the header main pipe.

The sixth header 17*b* allows the refrigerant to flow into or out of each of the heat transfer pipes of the third heat source side heat exchanger 12*c* through the branch pipe connected to the heat transfer pipe.

Due to this configuration, the flow of the refrigerant in the cooling operation mode is as follows. The high-temperature, high-pressure gas refrigerant discharged from the compressor 10, at first, branches to flow into the two refrigerant flow switching devices 11*a* and 11*b*. A portion of the gas refrigerant flows into the first heat source side heat exchanger 12*a* via the refrigerant flow switching device 11*a* and the first header 14*a*. The remaining gas refrigerant flows into the third heat source side heat exchanger 12*c* via the refrigerant flow switching device 11*b* and the fifth header 17*a*.

Then, in the first heat source side heat exchanger 12*a* and the third heat source side heat exchanger 12*c* connected to each other in parallel, the flows of the gas refrigerant are converted into flows of high-pressure two-phase or liquid refrigerant by transferring heat to the outdoor air supplied from the fan 16. The portion of the high-pressure refrigerant, which has flowed out of the first heat source side heat exchanger 12*a*, flows into the series pipe 6 via the second header 14*b*. The remaining high-pressure refrigerant, which has flowed out of the third heat source side heat exchanger 12*c*, flows into the series pipe 6 via the sixth header 17*b* and the fourth parallel pipe 18, and the flows of the high-pressure refrigerant join.

The joined flows of the high-pressure refrigerant flow into the second heat source side heat exchanger 12*b* via the series pipe 6, the first opening and closing device 30, which is switched to the open state, and the third header 15*a*. Then, in the second heat source side heat exchanger 12*b*, the high-pressure refrigerant is converted into high-pressure liquid refrigerant by transferring heat to the outdoor air supplied from the fan 16. The high-pressure liquid refrigerant flows out of the outdoor unit 1 via the third parallel pipe 9, travels through the main pipe 4, and flows into the indoor unit 2.

As described above, when a plurality of heat source side heat exchangers are arranged separately from each other, the first heat source side heat exchanger 12*a* and the second heat source side heat exchanger 12*b* are arranged to be coupled together vertically in such a manner as to share some fins. The third heat source side heat exchanger 12*c* is arranged separately from each other without sharing fins. This can reduce the total number of headers to be used for heat source side heat exchangers, compared to a case when the independent third heat source side heat exchanger 12*c* also shares fins, and can construct a system at low cost. The reduction in the total number of headers can simplify the connection path of a connection pipe, which is the refrigerant pipe 3, leading to a reduction in the size of the air-conditioning apparatus 300.

A combination of the first heat source side heat exchanger 12*a* and the third heat source side heat exchanger 12*c* in Embodiment 3 can also be understood to provide the same function as that of the first heat source side heat exchanger 12*a* in Embodiments 1 and 2.

The embodiments of the present invention are described above, and the present invention is not limited to the above-described embodiments and various modifications are possible.

For example, refrigerant may be implemented as, instead of R410A refrigerant, R32 refrigerant or a refrigerant mixture (non-azeotropic refrigerant mixture) of R32 refrigerant and tetrafluoropropene-based refrigerant having a small global warming potential and having a chemical formula represented by $CF_3CF{=}CH_2$, such as HFO1234yf or HFO1234ze. The use of refrigerant whose high-pressure side operates at supercritical state, such as $CO_2$ (R744), also achieves similar advantageous effects.

In Embodiments 1 to 3, the first heat source side heat exchanger 12*a* and the second heat source side heat exchanger 12*b* are integrally formed in such a manner as to share some fins, by way of example. However, the first heat source side heat exchanger 12*a* and the second heat source side heat exchanger 12*b* may be arranged to be independent of each other. Alternatively, the second heat source side heat exchanger 12*b* may be arranged on the upper side. Further, the second heat source side heat exchanger 12*b* is formed below the fins, and the first heat source side heat exchanger 12*a* is formed above the fins, by way of example. However, the second heat source side heat exchanger 12*b* may be formed above the fins, and the first heat source side heat exchanger 12*a* may be formed below the fins.

In Embodiments 1 to 3 described above, a cooling and heating switching air-conditioning apparatus has been described, by way of example. However, an air-conditioning apparatus capable of performing cooling and heating simultaneously may also include a heat exchanger flow switching device formed of a plurality of valves, in which the advantage of improving refrigeration cycle efficiency by connecting condensers to each other in series and connecting evaporators to each other in parallel can be achieved.

In Embodiments 1 to 3 described above, a configuration is described in which a single fan 16 is mounted, by way of example, and the present invention is not limited thereto. A model having a plurality of fans mounted therein also achieves similar advantageous effects. Furthermore, similar advantageous effects can be obtained, regardless of the installation type of the fans, e.g. a top-flow fan or a side-flow fan.

The description has been made taking a low-pressure shell compressor as an example of a compressor of the embodiments. However, the use of a high-pressure shell compressor, for example, also achieves similar advantages.

Furthermore, the description has been made taking, as an example, the use of a compressor that does not have a structure for allowing refrigerant to flow into the medium-pressure portion of the compressor. However, a compressor having a structure including an injection port for allowing refrigerant to flow into the medium-pressure portion of the compressor may also be used.

In general, a heat source side heat exchanger and a load side heat exchanger are each provided with a fan serving as an air-sending device that promotes condensation or evaporation of refrigerant through blowing of air. However, this should not be construed as limiting. For example, a load side heat exchanger may be used as a device that utilizes radiation, such as a panel heater. A heat source side heat exchanger may be implemented as a water-cooled heat exchanger that exchanges heat by using a fluid such as water or antifreeze solution. Any type of heat exchanger that enables refrigerant to transfer or remove heat may be used.

When a water-cooled heat exchanger is used, it is desirable to install and use a water-refrigerant heat exchanger such as a plate heat exchanger or a double pipe heat exchanger.

REFERENCE SIGNS LIST

1 outdoor unit 2 indoor unit 3 refrigerant pipe 4 main pipe 5 primary pipe 5*a* second primary pipe 6 series pipe 7 first parallel pipe 8 second parallel pipe 9 third parallel pipe 10 compressor 11 refrigerant flow switching device 11*a* refrigerant flow switching device 11*b* refrigerant flow switching device 12*a* first heat source side heat exchanger 12*b* second heat source side heat exchanger 12*c* third heat source side heat exchanger 14*a* first header 14*b* second header 15*a* third header 15*b* fourth header 16 fan 17*a* fifth header 17*b* sixth header 18 fourth parallel pipe 21 load side heat exchanger 22 load side expansion device 30 first opening and closing device 31 second opening and closing device 32 third opening and closing device 33 fourth opening and closing device 41 pressure sensor 46 first temperature sensor 47 second temperature sensor 48 third temperature sensor 49 low pressure sensor 50 header main pipe 51 branch pipe 60 controller 100 air-conditioning apparatus 200 air-conditioning apparatus 300 air-conditioning apparatus

The invention claimed is:

1. An air-conditioning apparatus comprising: a main circuit in which a compressor, a refrigerant flow switching valve, a load side heat exchanger, a load side expansion valve, and a plurality of heat source side heat exchangers are sequentially connected by a pipe and in which refrigerant circulates, wherein the plurality of heat source side heat exchangers include a first heat source side heat exchanger and a second heat source side heat exchanger, when the plurality of heat source side heat exchangers are used as condensers, the first heat source side heat exchanger and the second heat source side heat exchanger are connected to each other in series by a series refrigerant flow path, when the plurality of heat source side heat exchangers are used as evaporators, the first heat source side heat exchanger and the second heat source side heat exchanger are connected to each other in parallel by a parallel refrigerant flow path, a distribution adjustment header adjusting distribution of the refrigerant is disposed at a position in a refrigerant flow path on an inlet side of at least either the first heat source side heat exchanger or the second heat source side heat exchanger when the plurality of heat source side heat exchangers are used as evaporators, the air-conditioning apparatus further comprises a heat exchanger flow switching valve switching between the series refrigerant flow path and the parallel refrigerant flow path, wherein the heat exchanger flow switching valve includes a first opening and closing valve arranged in a series pipe and configured to permit or block passage of the refrigerant through the series pipe, the series pipe coupling the first heat source side heat exchanger and the second heat source side heat exchanger together in series, a second opening and closing valve arranged in a first parallel pipe and configured to permit or block passage of the refrigerant through the first parallel pipe, the first parallel pipe coupling the first heat source side heat exchanger and the load side expansion valve together, and a third opening and closing valve arranged in a second parallel pipe and configured to permit or block passage of the refrigerant through the second parallel pipe, the second parallel pipe coupling the refrigerant flow switching valve and the second heat source side heat exchanger together.

2. The air-conditioning apparatus of claim 1, wherein the distribution adjustment header is disposed at a position in the refrigerant flow path on the inlet side of each of the plurality of heat source side heat exchangers when the plurality of heat source side heat exchangers are used as evaporators.

3. The air-conditioning apparatus of claim 1, wherein the distribution adjustment header includes a header main pipe connected to the pipe in the main circuit, and a plurality of branch pipes, each of which is connected to a heat transfer pipe, the heat transfer pipe being an element constituting a heat exchanger, and the plurality of branch pipes protrude toward an inside of the header main pipe.

4. The air-conditioning apparatus of claim 3, wherein the heat transfer pipe is a flat pipe.

5. The air-conditioning apparatus of claim 3, wherein leading ends of the plurality of branch pipes protruding toward the inside of the header main pipe are located between a position equal to 50% of an inner radius of the header main pipe from an inner wall portion of the header main pipe on a side of the header main pipe in a direction in which the plurality of branch pipes are inserted and a position equal to 50% of an inner radius of the header main pipe from the inner wall portion of the header main pipe on a side of the header main pipe from which the plurality of branch pipes are inserted.

6. The air-conditioning apparatus of claim 5, wherein the leading ends of the plurality of branch pipes protruding toward the inside of the header main pipe are located in a center portion of the header main pipe.

7. The air-conditioning apparatus of claim 3, wherein the header main pipe extends in a vertical direction, and the plurality of branch pipes are arranged in parallel to each other in the vertical direction and extend in a horizontal direction.

8. The air-conditioning apparatus of claim 7, wherein a lower portion of the header main pipe is connected to the pipe in the main circuit.

9. The air-conditioning apparatus of claim 1, wherein first heat source side heat exchanger is formed to have a larger heat transfer area than a heat transfer area of the second heat source side heat exchanger.

10. The air-conditioning apparatus of claim 1, wherein a portion of the first heat source side heat exchanger and the second heat source side heat exchanger are integrally formed in such a manner as to share a fin, the fin being an element constituting a heat exchanger, and a remaining portion other than the portion of the first heat source side heat exchanger is formed to be separate from the second heat source side heat exchanger.

11. The air-conditioning apparatus of claim 1, when the plurality of heat source side heat exchangers are used as condensers, the series refrigerant flow path is established with the first opening and closing valve opened, the second opening and closing valve closed, and the third opening and closing valve closed.

12. The air-conditioning apparatus of claim 1, wherein the heat exchanger flow switching valve includes a fourth opening and closing valve arranged in a third parallel pipe and configured to permit or block passage of the refrigerant through the third parallel pipe, the third parallel pipe coupling the second heat source side heat exchanger and the load side expansion valve together, and wherein the fourth opening and closing valve is an expansion valve capable of adjusting a flow rate by changing an opening degree thereof.

13. The air-conditioning apparatus of claim 12, wherein the second opening and closing valve is an expansion valve capable of adjusting a flow rate by changing an opening degree thereof, and wherein in the heat exchanger flow switching valve, the plurality of heat source side heat exchangers are used as condensers, the series refrigerant flow path is established with the second opening and closing valve closed and the fourth opening and closing valve opened, and when the plurality of heat source side heat exchangers are used as evaporators, the parallel refrigerant flow path is established such that the respective opening degrees of the second opening and closing valve and the fourth opening and closing valve are changed to adjust amounts of the refrigerant flowing into the first heat source side heat exchanger and the second heat source side heat exchanger.

14. The air-conditioning apparatus of claim 1, wherein the third opening and closing valve is formed by a backflow prevention valve that prevents the refrigerant from flowing into a flow path on the inlet side of the second heat source side heat exchanger from a flow path on the inlet side of the first heat source side heat exchanger through the second parallel pipe when the plurality of heat exchangers are used as condensers.

15. An air-conditioning apparatus comprising: a main circuit in which a compressor, a refrigerant flow switching valve, a load side heat exchanger, a load side expansion valve, and a plurality of heat source side heat exchangers are sequentially connected by a pipe and in which refrigerant circulates, wherein the plurality of heat source side heat exchangers include a first heat source side heat exchanger and a second heat source side heat exchanger, when the plurality of heat source side heat exchangers are used as condensers, the first heat source side heat exchanger and the second heat source side heat exchanger are connected to each other in series by a series refrigerant flow path, when the plurality of heat source side heat exchangers are used as evaporators, the first heat source side heat exchanger and the second heat source side heat exchanger are connected to each other in parallel by a parallel refrigerant flow path, and a header is disposed at a position in a refrigerant flow path on an outlet side of at least the first heat source side heat exchanger when the plurality of heat source side heat exchangers are defrosted, the air-conditioning apparatus further comprises a heat exchanger flow switching valve that switches between the series refrigerant flow path and the parallel refrigerant flow path, wherein the heat exchanger flow switching valve includes a first opening and closing valve arranged in a series pipe and configured to permit or block passage of the refrigerant through the series pipe, the series pipe coupling the first heat source side heat exchanger and the second heat source side heat exchanger together in series, a second opening and closing valve arranged in a first parallel pipe and configured to permit or block passage of the refrigerant through the first parallel pipe, the first parallel pipe coupling the first heat source side heat exchanger and the load side expansion valve together, and a third opening and closing valve arranged in a second parallel pipe and configured to permit or block passage of the refrigerant through the second parallel pipe, the second parallel pipe coupling the refrigerant flow switching valve and the second heat source side heat exchanger together, wherein when the plurality of heat source side heat exchangers are used as condensers or are defrosted, the series refrigerant flow path is established with the first opening and closing valve opened, the second opening and closing valve closed, and the third opening and closing valve closed, and when the plurality of heat source side heat exchangers are used as evaporators, the parallel refrigerant flow path is established with the first opening and closing valve closed, the second opening and closing valve opened, and the third opening and closing valve opened.

16. The air-conditioning apparatus of claim 15, wherein the header is a header for distribution adjustment, and wherein the header for distribution adjustment is disposed at a position in a refrigerant flow path on an inlet side of each of the plurality of heat source side heat exchangers when the plurality of heat source side heat exchangers are used as evaporators.

17. An air-conditioning apparatus, comprising a main circuit in which a compressor, a refrigerant flow switching valve, a load side heat exchanger, a load side expansion valve, and a plurality of heat source side heat exchangers are sequentially connected by a pipe and in which refrigerant circulates, wherein the plurality of heat source side heat exchangers include a first heat source side heat exchanger and a second heat source side heat exchanger, when the plurality of heat source side heat exchangers are used as condensers, the first heat source side heat exchanger and the second heat source side heat exchanger are connected to each other in series by a series refrigerant flow path, when the plurality of heat source side heat exchangers are used as evaporators, the first heat source side heat exchanger and the second heat source side heat exchanger are connected to each other in parallel by a parallel refrigerant flow path, and a header is disposed at a position in a refrigerant flow path on an outlet side of at least the first heat source side heat exchanger when the plurality of heat source side heat exchangers are defrosted heat exchanger flow switching valve that switches between the series refrigerant flow path and the parallel refrigerant flow path, a heat exchanger flow switching valve that switches between the series refrigerant flow path and the parallel refrigerant flow path is provided, wherein the heat exchanger flow switching valve includes a first opening and closing valve arranged in a series pipe and configured to permit or block passage of the refrigerant through the series pipe, the series pipe coupling the first heat source side heat exchanger and the second heat source side heat exchanger together in series, a second opening and closing valve arranged in a first parallel pipe and configured to permit or block passage of the refrigerant through the first parallel pipe, the first parallel pipe coupling the first heat source side heat exchanger and the load side expansion valve together, and a third opening and closing valve arranged in a second parallel pipe and configured to permit or block passage of the refrigerant through the second parallel pipe, the second parallel pipe coupling the refrigerant flow switching valve and the second heat source side heat exchanger together, wherein when the plurality of heat source side heat exchangers are used as condensers or are defrosted, the series refrigerant flow path is established with the first opening and closing valve opened, the second opening and closing valve closed, and the third opening and closing valve closed, and when the plurality of heat source side heat exchangers are used as evaporators, the parallel refrigerant flow path is established with the first opening and closing valve closed, the second opening and closing valve opened, and the third opening and closing valve opened.

18. The air-conditioning apparatus of claim 1, wherein when the plurality of heat source side heat exchangers are used as evaporators, the parallel refrigerant flow path is established with the first opening and closing valve closed, the second opening and closing valve opened, and the third opening and closing valve opened.

* * * * *